US009850890B2

(12) United States Patent
Lim et al.

(10) Patent No.: US 9,850,890 B2
(45) Date of Patent: Dec. 26, 2017

(54) DEVICE AND METHOD FOR CONTROLLING LINEAR COMPRESSOR

(71) Applicant: LG ELECTRONICS INC., Seoul (KR)

(72) Inventors: Sungjin Lim, Seoul (KR); Nayi Ryu, Seoul (KR); Sungho Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 351 days.

(21) Appl. No.: 14/570,550

(22) Filed: Dec. 15, 2014

(65) Prior Publication Data

US 2015/0176579 A1 Jun. 25, 2015

(30) Foreign Application Priority Data

Dec. 19, 2013 (KR) ..... 10-2013-0159529

(51) Int. Cl.
*F04B 49/06* (2006.01)
*F04B 35/04* (2006.01)
(Continued)

(52) U.S. Cl.
CPC ..... *F04B 49/06* (2013.01); *F04B 35/04* (2013.01); *F04B 35/045* (2013.01);
(Continued)

(58) Field of Classification Search
CPC ..... F04B 35/04; F04B 35/045; F04B 49/06; F04B 49/065; F04B 2201/12;
(Continued)

(56) References Cited

U.S. PATENT DOCUMENTS 6,000,232 A * 12/1999 Witten-Hannah ..... F25D 17/065 165/208
9,091,272 B2 * 7/2015 Kim ..... F04D 27/00
(Continued)

FOREIGN PATENT DOCUMENTS

CN 1168965 12/1997
CN 1432736 7/2003
(Continued)

OTHER PUBLICATIONS

Chinese Office Action dated Jun. 3, 2016 issued in Application No. 201410784869.X (English translation attached).
(Continued)

*Primary Examiner* — Devon Kramer
*Assistant Examiner* — Benjamin Doyle
(74) *Attorney, Agent, or Firm* — KED & Associates, LLP

(57) ABSTRACT

The control module includes a drive circuitry that drives the linear compressor based on a control signal, a detector that detects a motor current and a motor voltage corresponding to a motor of the linear compressor, an asymmetric current generator that generates an asymmetric motor current by applying a current offset to the detected motor current, and a controller that generates the control signal based on the asymmetric motor current and the detected motor voltage. Such a control module may increase a maximum freezing capacity by appropriately (or optimally) designing (setting) an initial value of a piston in a driving area or an operation area (or a high-efficiency driving area) of a compressor by considering the efficiency aspect, and executing an asymmetric operation in a high-load driving area (or a high freezing capacity driving area).

18 Claims, 14 Drawing Sheets

(51) Int. Cl.
*F25B 31/02* (2006.01)
*F25B 49/02* (2006.01)

(52) U.S. Cl.
CPC ..... *F04B 49/065* (2013.01); *F25B 31/023* (2013.01); *F25B 49/022* (2013.01); *F04B 2203/0401* (2013.01); *F04B 2203/0402* (2013.01)

(58) Field of Classification Search
CPC ..... F04B 2203/0401; F04B 2203/0402; F04B 2201/0206; F04B 2203/0201; F25B 31/023; F25B 49/022; F25B 2600/024; F25B 2700/151; F25B 2500/19; F25B 49/025; F25B 2400/073; H02P 25/06
USPC ..... 417/44.11; 318/599, 811, 432, 434, 471; 388/809, 811, 815, 819, 934
See application file for complete search history.

(56) References Cited

U.S. PATENT DOCUMENTS 9,366,246 B2 * 6/2016 Yoo ..... F04B 49/02
2002/0062652 A1 5/2002 Hwang et al.
2002/0064463 A1 5/2002 Park et al.
2002/0150477 A1 10/2002 Hwang et al.
2003/0133807 A1 * 7/2003 Heo ..... F04B 49/065 417/44.11
2004/0108825 A1 6/2004 Lee et al.
2006/0228224 A1 * 10/2006 Hong ..... F04B 35/045 417/44.1
2006/0257264 A1 * 11/2006 Kim ..... F04B 35/045 417/44.1
2007/0241698 A1 * 10/2007 Sung ..... F04B 35/045 318/135
2007/0295201 A1 * 12/2007 Dadd ..... F04B 35/045 92/10
2008/0150456 A1 * 6/2008 Heo ..... F25B 49/025 318/119
2011/0058964 A1 * 3/2011 Kang ..... F04B 35/045 417/410.1
2011/0247712 A1 * 10/2011 Sugioka ..... F04B 19/006 137/808
2012/0034104 A1 * 2/2012 Hu ..... F04B 17/04 417/45
2012/0301323 A1 * 11/2012 Yoo ..... F04B 35/04 417/44.1
2013/0189119 A1 * 7/2013 Dainez ..... F04B 35/045 417/45
2013/0192294 A1 * 8/2013 Yoo ..... F04B 49/02 62/510
2013/0195612 A1 * 8/2013 Kim ..... F04D 27/00 415/1
2013/0195677 A1 * 8/2013 Yoo ..... F04B 35/04 417/45
2013/0195678 A1 * 8/2013 Yoo ..... F04D 27/005 417/45
2014/0072461 A1 * 3/2014 Barito ..... F04B 35/045 417/415
2014/0340003 A1 * 11/2014 Silvia ..... F04B 35/045 318/128
2015/0176579 A1 * 6/2015 Lim ..... F04B 35/04 62/230
2016/0053754 A1 * 2/2016 Kang ..... F04B 35/045 417/45
2016/0153442 A1 * 6/2016 Lim ..... F04B 49/20 417/45

FOREIGN PATENT DOCUMENTS

CN 1815018 8/2006
CN 104728074 A * 6/2015 ..... F04B 35/04
WO WO 2005/045248 A1 5/2005

OTHER PUBLICATIONS

European Search Report dated May 11, 2015 issued in Application No. 14197393.3.

* cited by examiner

DEVICE AND METHOD FOR CONTROLLING LINEAR COMPRESSOR

CROSS-REFERENCE TO RELATED APPLICATION

This application claims priority under 35 U.S.C. §119 to Korean Application No. 10-2013-0159529, filed on Dec. 19, 2013, whose entire disclosure is incorporated by reference herein in its entirety.

BACKGROUND

1. Field

This specification relates to a device and method for controlling a linear compressor.

2. Background

In general, a reciprocating compressor is configured in such a manner that a piston linearly reciprocates within a cylinder to suck, compress and discharge refrigerant gas, and more particularly, is classified into a recipro type and a linear type according to a method of driving the piston.

The recipro type is a method in which a crankshaft is coupled to a rotation motor and a piston is coupled to the crankshaft so as to convert a rotational motion of the rotation motor into a linear reciprocating motion. On the other hand, the linear type is a method in which a piston is directly connected to a mover of a linear motor so as to perform a reciprocating motion in response to a linear motion of the motor.

The linear type reciprocating compressor does not employ the crankshaft which converts the rotational motion into the linear motion, as aforementioned, so as to exhibit a low frictional loss and higher compression efficiency than general compressors.

When the reciprocating compressor is used for a refrigerator or an air conditioner, a compression ratio of the reciprocating compressor may be varied by varying a voltage input to the reciprocating compressor. This may allow for controlling a freezing capacity.

FIG. 1 is a block diagram of a driving control module of a general reciprocating compressor. A current detector 4 detects a motor current applied to a motor, and a voltage detector 3 detects a motor voltage applied to the motor. A stroke estimator 5 estimate a stroke based on the detected motor current and motor voltage and a motor parameter. A comparator 1 compares the stroke estimate with a stroke command value (or a stroke instruction value) to output a difference signal. A controller 2 controls the stroke by changing (varying) the voltage applied to the motor.

In operation, the current detector 4 may detect the motor current applied to the motor, and the voltage detector 3 may detect the motor voltage applied to the motor. Here, the stroke estimator 5 may calculate a stroke estimate by applying the motor current and motor voltage and the motor parameter to the following Equation 1, and apply the stroke estimate to the compressor 1.

$$X = \frac{1}{\alpha}\int (V_M - Ri - L\dot{i})dt \qquad \text{[Equation 1]}$$

where R denotes resistance, L denotes inductance and a denotes a motor constant or a counter electromotive force constant.

The comparator 1 may compare the stroke estimate with the stroke command value and apply a thusly-obtained difference signal to the controller 2. The controller 2 may then control the stroke by varying the voltage applied to the motor of the linear compressor L-COMP. As illustrated in FIG. 2, the controller may reduce the voltage applied to the motor when the stroke estimate is greater than the stroke command value, and increase the voltage applied to the motor when the stroke estimate is smaller than the stroke command value.

Generally, a refrigerator as a home appliance runs for 24 hours. Among others, efficiency of a compressor may have the greatest influence on the power consumption of the refrigerator, and the efficiency of the compressor should be increased in order to reduce the power consumption of the refrigerator.

One of methods of increasing efficiency of a linear compressor may be to reduce a frictional loss. To reduce the frictional loss, an initial value of a piston (or an initial position at which the piston is located in a cylinder) may be reduced so as to decrease a stroke. However, the compressor efficiency and the maximum freezing capacity by the initial value of the piston may have a trade-off relationship.

The initial value of the piston is a factor which decides the maximum freezing capacity. The reduction of the initial value may result in an increase in the efficiency of the compressor based on the reduction of the frictional loss, but results in a reduction of the maximum freezing capacity and making it difficult to handle (manage) an overload.

Further, when the initial value is increased, the maximum freezing capacity of the compressor can be improved, but a moving distance (a distance between a top dead center (TDC) and a bottom dead center (BDC)) of the piston may be increased. This may cause an increase of a frictional loss and accordingly reduce efficiency of the compressor.

A top dead center is abbreviated as "TDC" and denotes a top dead center of the piston in the linear compressor. The TDC may physically indicate a stroke upon completion of a compression stroke of the piston. A point where the TDC is 0 (TDC=0) is simply referred to as 'top dead center.' Similarly, the bottom dead center is abbreviated as "BDC" and may physically indicate a stroke upon completion of a suction stroke of the piston.

BRIEF DESCRIPTION OF THE DRAWINGS

The embodiments will be described in detail with reference to the following drawings in which like reference numerals refer to like elements wherein.

DETAILED DESCRIPTION

Figure 1:
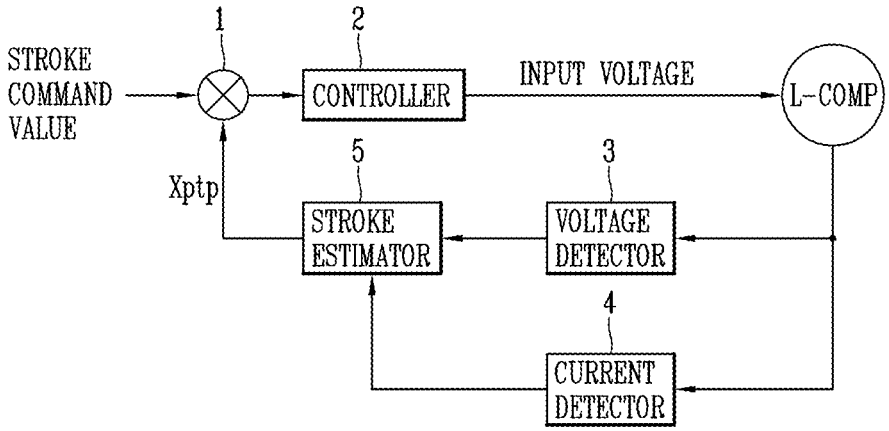
FIG. 1 is a block diagram of a driving control module of a reciprocating compressor.

FIG. 3 is a view illustrating a configuration of a control module of a linear compressor according to an embodiment disclosed herein. A control module 100 of a linear compressor may be a device for controlling or driving a linear compressor LC100. The control module 100 may include a drive circuitry DRV100, a detector D100, an asymmetric current generator IA100, and a controller C100.

The drive circuitry DRV100 may generate a motor driving signal s_pwm, which is applied to the linear compressor LC 100 to drive the linear compressor LC100. The motor driving signal s_pwm may have a form of an alternating voltage signal or an alternating current signal. The drive circuitry DRV100 may receive a control signal s_con applied from the controller C100, to drive the linear compressor LC100 based on the control signal s_con. In accordance with one embodiment, the drive circuitry DRV100 may be implemented using an inverter or a triac.

The detector D100 (see FIG. 3) may be configured to detect a motor current Im and a motor voltage Vm corresponding to the motor of the linear compressor. The detector D100 may include a current detector for detecting the motor current Im, and a voltage detector for detecting the motor voltage Vm. The current detector may detect a motor current applied to the motor of the linear compressor according to a load of the linear compressor LC100 or a load of a refrigeration system (or a refrigerator) to which the linear compressor LC100 is applied. The motor current Im refers to a current applied to a linear compressor motor, namely, a linear motor, and may be detected by a current sensor and the like.

The voltage detector may detect a motor voltage which is applied between both ends of the linear motor according to the load of the linear compressor LC100. The motor voltage Vm refers to a voltage applied to the linear motor, and may be detected by a voltage sensor (it may be implemented as a voltage-differential amplifier or the like), etc.

The asymmetric current generator IA100 may be configured to generate an asymmetric motor current for an asymmetric control, which allows for increasing the maximum freezing capacity by electrically moving an initial value of the piston, when the load of the linear compressor LC100 is increased, e.g., when a high freezing capacity is required. The asymmetric current generator IA100 may generate an asymmetric motor current Im_asym by applying a current offset to the motor current Im which has been detected by the detector D100. The current offset may serve as an electric control to adjust an initial position (or the initial value) of the piston within the motor of the linear compressor.

When a larger current offset is applied, the initial value of the piston may be moved closer to a bottom dead center, thereby increasing the maximum output freezing capacity. In other words, when a larger current offset is applied, an average position (or a central position) of a reciprocating motion of the piston is pushed (moved) closer to the bottom dead center from an initially-set position of the piston. This may be referred to as a piston push amount.

When the larger current offset is applied, an asymmetric control amount (or the push amount) may be increased such that a reciprocating distance of the piston can be increased. This may result in an increase in the maximum output freezing capacity. In other words, the control module of the linear compressor disclosed herein may control the piston push amount from the initial position of the piston by adjusting the current offset, thereby adjusting the efficiency of the linear compressor LC100 and the maximum freezing capacity.

The current offset may be decided in various manners or automatically changed. For example, the current offset may be decided (or changed) according to an operation mode of the linear compressor LC100. As another example, the current offset may be decided or changed according to the load of the linear compressor LC100 or the change in a freezing capacity command value corresponding to the linear compressor LC100.

Figure 3A:
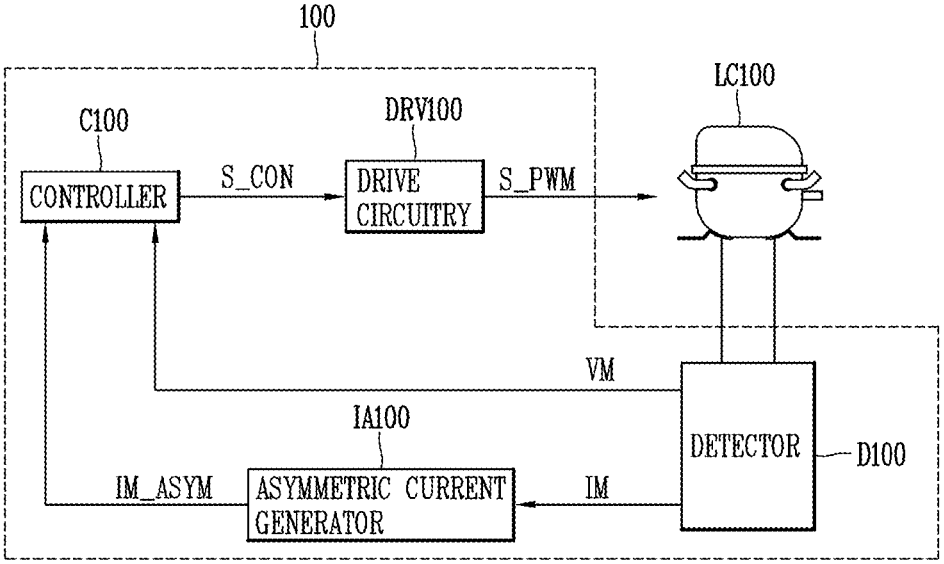
FIG. 3A is a view illustrating a configuration of a controller of a linear compressor in accordance with an embodiment disclosed herein.
Figure 3B:
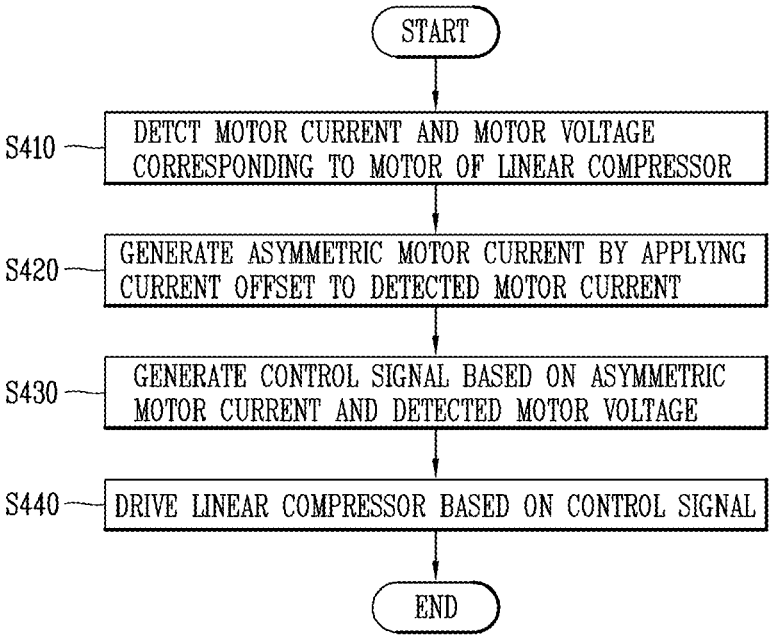
FIG. 3B is a flowchart illustrating a compressor control method in accordance with an embodiment disclosed herein.

FIG. 3B is a flowchart illustrating a compressor control method of the control device illustrated in FIG. 3A. A motor current and a motor voltage corresponding to a motor of a linear compressor may be detected (S410). An asymmetric motor current may be generated by applying a current offset to the detected motor current (S420). A control signal may then be generated based on the asymmetric motor current and the detected motor voltage (S430). The linear compressor may be driven based on the control signal (S440).

FIG. 4 illustrates implantation of the drive circuitry DRV100 using an inverter, specifically, a full-bridge type inverter.

The full-bridge type inverter module, as illustrated in FIG. 4, may include four switches or transistors Q1 to Q4. The full-bridge type inverter module may further include diodes D1 to D4 as freewheels, which are connected in parallel to the four switches or transistors Q1 to Q4, respectively. The four switching elements Q1 to Q4 may be at least one of an insulated gate bipolar transistor (IGBT), MOSFET or BJT.

Figure 4A:
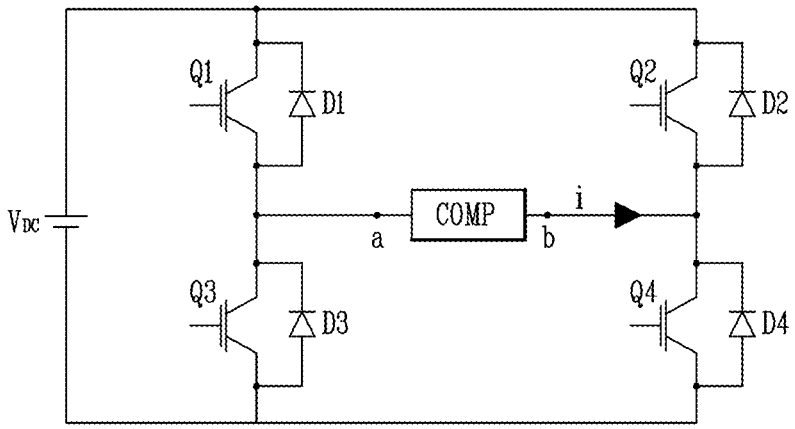
FIGS. 4A-4B are exemplary views illustrating an operation of a drive circuitry implemented as an inverter.

The controller C100 may supply or apply the control signal s_con to the drive circuitry DRV100 in the form of a voltage control signal which may be generated by a pulse width modulation (PWM) method as shown in FIG. 4A. In order for a current to flow in a forward direction (a→b) of a compressor Comp, the switching elements Q and Q4 may be turned on and the switching elements Q2 and Q3 may be turned off. In order for the current to flow in a backward direction (b→a) of the compressor Comp, the switching elements Q1 and Q4 may be turned off, and the switching elements Q2 and Q3 may be turned on.

Figure 4B:
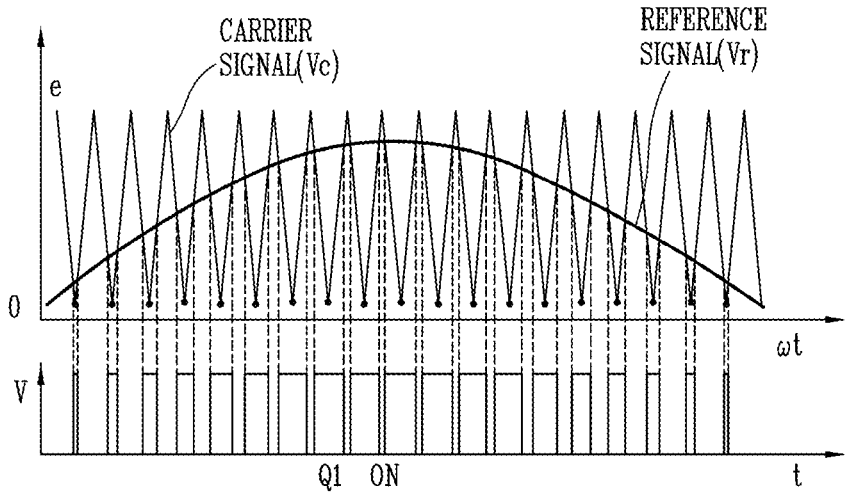

Referring to (b) of FIG. 4B, two signals may be required to modulate a pulse width of the control signal s_con for driving the motor of the linear compressor. One signal may be a carrier signal Vc, and the other may be a reference signal Vr. The carrier signal may use a chopping wave, and the reference signal having a form of sine wave may serve as a command value for controlling the drive circuitry DRV100.

The reference signal may be a table voltage which is output on a constant frequency on the sin table basis. The reference signal may have the form of sine wave within a periodic discrete time area. Therefore, the controller C100 may control the linear compressor LC100 in a manner of adjusting a size, a shape and a DC average value (or a DC offset value) of the reference signal.

The controller may generate a control signal s_con, e.g., Q1, for controlling the switching element to be turned on when the voltage of the reference signal Vr is greater than the voltage of the carrier signal Vc, and for controlling the switch to be turned off vice versa when voltage of reference signal Vr is less than the voltage of carrier signal Vc. When the reference signal or the voltage command value is increased, a portion where the reference signal is greater than the carrier signal may be increased, which may extend a turn-on time of the switching element, as shown in the middle portion of the time t. This may result in an increase in a size (magnitude) of a voltage or current applied to the motor.

Figure 5:
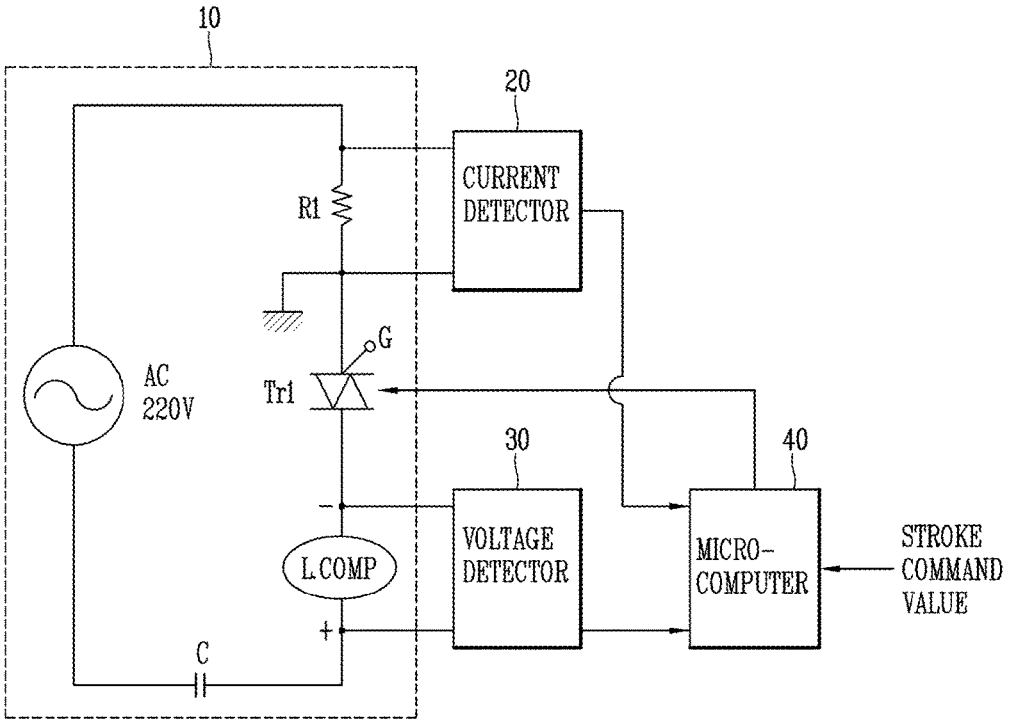
FIG. 5 is a block diagram illustrating a configuration of a drive control module of a reciprocating compressor using a triac.

FIG. 5 is a block diagram illustrating a configuration of a control module of a reciprocating compressor L.COMP includes a triac Tr1. A control module of a reciprocating compressor using a triac adjusts a freezing capacity by varying a stroke, in such a manner of moving a piston up and down, in response to a stroke voltage according to a stroke command value. A voltage detector 30 detects a voltage generated in the reciprocating compressor L.COMP, in response to an increase in the stroke by the stroke voltage, and a current detector 20 detects a current applied to the reciprocating compressor L.COMP, in response to the increase in the stroke by the stroke voltage. A microcomputer 40 calculates the stroke based on the voltage and the current detected by the voltage detector 30 and the current detector 20, respectively, and compares the calculated stroke with a stroke command value to output a corresponding switching control signal. An electric circuit 10 applies the stroke voltage to the reciprocating compressor L.COMP by switching on or off an AC power source using a triac Tr1 according to the switching control signal of the microcomputer 40. As can be appreciated, the current detector 20, the voltage detector 30 and the microcomputer 40 may be implemented into one controller (or a one chip).

In operation of the driving control module using the triac, the piston of the reciprocating compressor L.COMP may perform a linear motion by the stroke voltage according to a stroke command value set by a user, and accordingly, a stroke may be varied, thereby adjusting a freezing capacity. A turn-on period of the triac Tr1 of the electric circuit 10 extends according to the switching control signal of the microcomputer 40, the stroke may increase. The voltage detector 30 and the current detector 20 may detect the voltage and the current, respectively, generated in the reciprocating compressor L.COMP, and apply the detected voltage and current to the microcomputer 40.

The microcomputer 40 may compute a stroke using the voltage and the current detected by the voltage detector 30 and the current detector 20, and compare the computed stroke with the stroke command value, to output a switching control signal. When the computed stroke is smaller than the stroke command value, the microcomputer 40 may output a switching control signal for extending the turn-on period of the triac Tr1 to increase the stroke voltage applied to the reciprocating compressor L.COMP.

Figure 6:
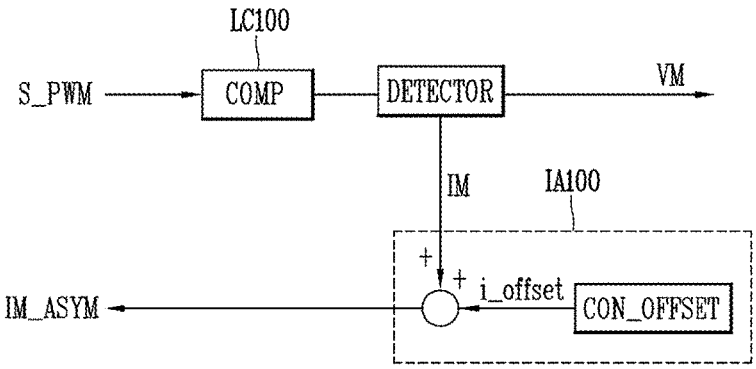
FIGS. 6 and 7 are exemplary views illustrating a method of detecting and generating an asymmetric motor current in accordance with an embodiment disclosed herein.
Figure 7:
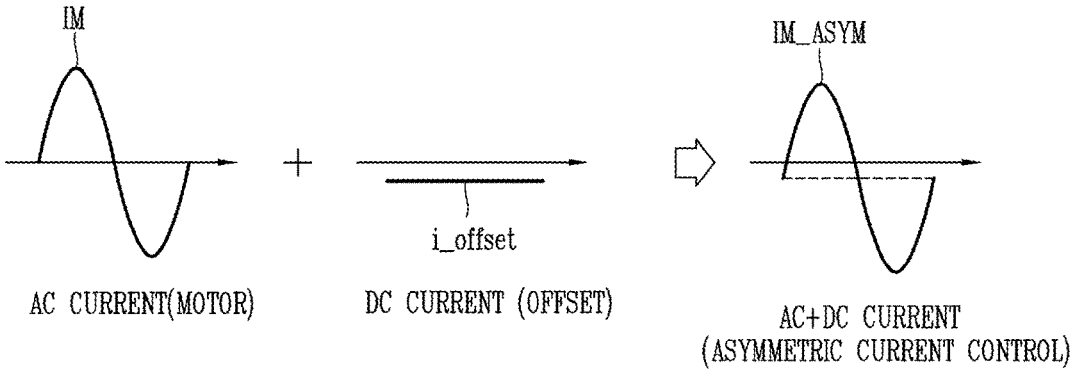

FIGS. 6 and 7 are exemplary views illustrating a method of detecting and generating an asymmetric motor current. The asymmetric current generator IA100 may include a combiner that combines the motor current Im detected by the detector D100 and a current offset i_offset generated by a current offset controller CON_OFFSET that generates the current offset i_offset. The current offset controller CON_OFFSET may control a piston push amount through an asymmetric control based on a current offset. Therefore, it may also be referred to as a push-back controller.

The current offset controller CON_OFFSET may determine the current offset i-offset according to a specific condition, and transfer the determined current offset i-offset to the combiner. The specific condition may be a condition associated with at least one of the operation mode of the linear compressor, the load of the linear compressor, and the freezing capacity command value corresponding to the linear compressor.

The current offset controller CON_OFFSET may store in a memory current offset values i_offset according to the specific condition in the form of table. When the specific condition is determined or applied from the exterior (for example, a main controller or a refrigerator micom), the current offset controller CON_OFFSET may decide a current offset i_offset according to the specific condition using the table.

For example, the current offset controller CON_OFFSET may set the current offset i_offset to '0' in a freezing capacity driving zone of 10 to 20 watts [W] such that a symmetric control can be executed, and set the current offset i_offset to a preset value, which differentially increases according to a specific constant value or an increase in a freezing capacity, in a freezing capacity driving zone over 200 [W].

Referring to FIG. 7, the current offset controller CON_OFFSET may generate an asymmetric motor current IM_ASYM by adding a current offset i_offset having a DC waveform to a detected motor current IM having an AC waveform. In accordance with one exemplary embodiment, the current offset i_offset may have a positive value or a negative value.

When the current offset i_offset has the negative value, the combiner of the current offset controller CON_OFFSET may be an adder. When the current offset i_offset has the positive value, the combiner of the current offset controller CON_OFFSET may be a subtracter to subtract an absolute value of the current offset i_offset from the motor current IM, thereby generating the asymmetric motor current IM_ASYM.

Figure 8:
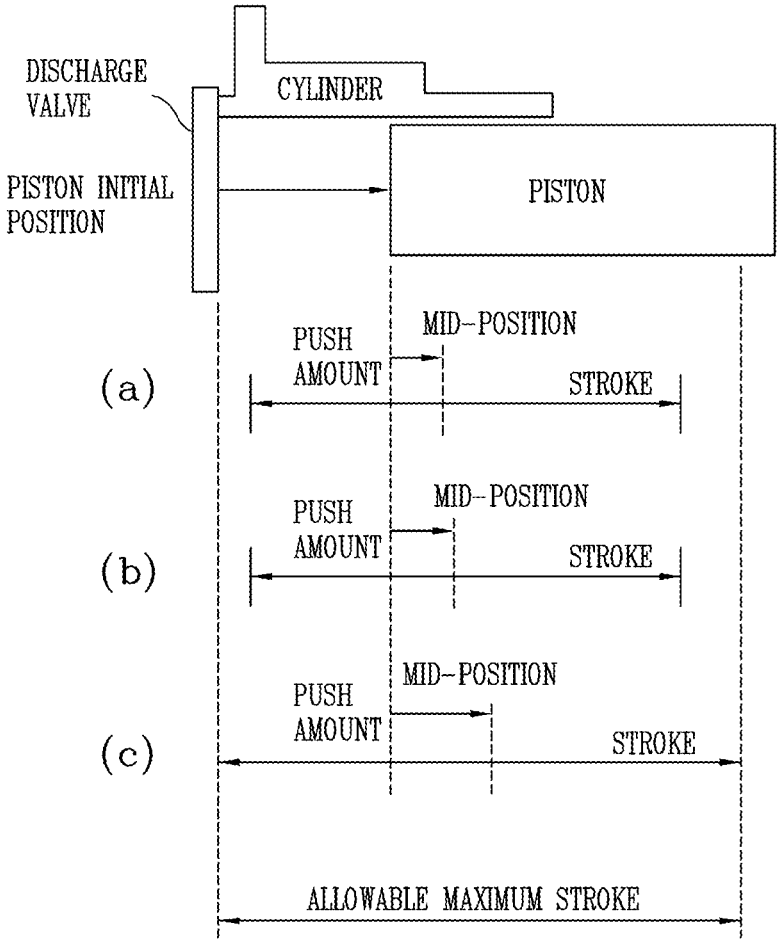
FIG. 8 illustrates an asymmetric control technology according to a control of a piston push(ed) amount (or a piston slip amount) in accordance with an embodiment disclosed herein.

FIG. 8 is an exemplary view illustrating an asymmetric control methodology to control a piston push amount. An initial position (e.g., a position of the piston with a cylinder) of the piston may be located at a point adjacent to a top dead center according to an initial setting. A middle point MID-POSITION (or an average position) of a moved distance by a suction-compression stroke of the piston may be located at a point adjacent to the top dead center.

As illustrated in (b) of FIG. 8, the piston push amount of the compressor L.comp may increase due to gas condensation through a compression stroke of the piston, and the initial position of the piston may have moved slightly toward a bottom dead center.

The control module 100 of the linear compressor may increase the piston push amount in a driving zone requiring high freezing capacity or a high-load driving area with a large compressor load. Accordingly, the compressor L.comp may ensure a maximum compression volume and accordingly can be driven with a maximum stroke.

For example, the control module 100 may execute an asymmetric control by generating an asymmetric motor current Im_asym by applying a current offset to the motor current Im detected by the detector D100, and controlling the linear compressor LC100 based on the generated asymmetric motor current Im_asym. In response to the asymmetric control, the piston push amount may be increased, and the compressor L.comp can ensure the maximum compression volume so as to be driven with a maximum stroke (see FIG. (c) of FIG. 8)

As discussed, the controller C100 may control the linear compressor LC100 based on the asymmetric motor current Im_asym and the detected motor voltage Vm.

The controller C100 may use the drive circuitry DRV100 to control the linear compressor LC100 by generating a control signal s_con based on the asymmetric motor current Im_asym and the detected motor voltage Vm. The controller C100 may detect a stroke based on the asymmetric motor current Im_asym and the detected motor voltage Vm, and generate the control signal s_con based on the detected stroke. The controller C100 may compare a stroke command value with the detected stroke, and generate the control signal s_con based on the comparison result. This compressor control method may be referred to as a stroke control method.

Figure 2:
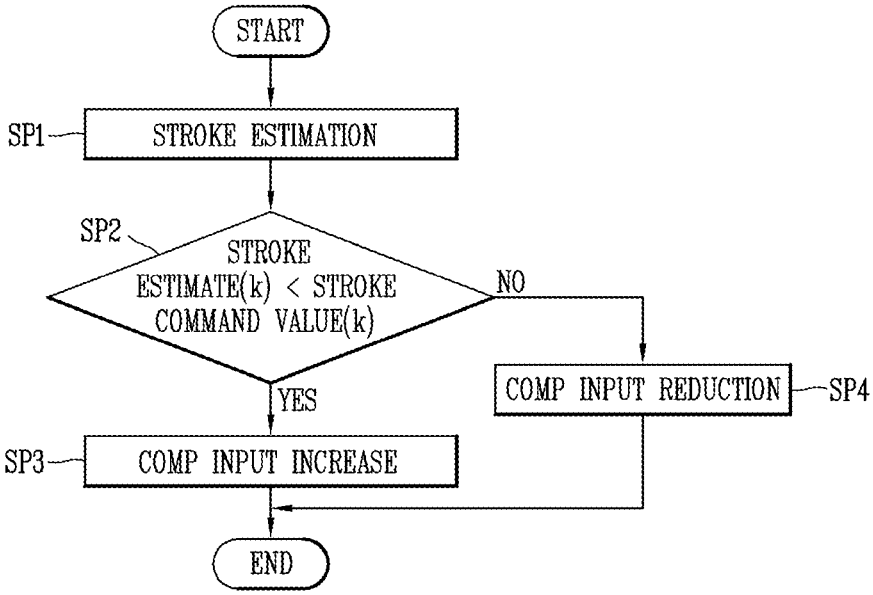
FIG. 2 is an operation flowchart illustrating a driving control method for a reciprocating compressor.

The stroke may be expressed by Equation 1 as aforementioned. This stroke control method is similar to the foregoing control method described with reference to FIGS. 1 and 2, and thus detailed description thereof may be omitted.

In accordance with one exemplary embodiment, the controller C100 may control the linear compressor LC 100 based on a phase of the detected asymmetric motor current or a gas spring constant.

The controller C100 may control output power of the linear compressor based on the phase of the detected asymmetric motor current or the gas spring constant. Further, the controller C100 may detect a top dead center of the linear compressor based on the phase of the detected asymmetric motor current or the gas spring constant, and control the linear compressor LC100 based on the detected top dead center.

In accordance with one exemplary embodiment, the controller C100 may detect a phase difference between the phase of the asymmetric motor current Im_asym and a phase of the detected stroke. The controller C100 may generate the control signal s_con such that the output power of the linear compressor can be controlled based on the phase difference. The controller C100 may also detect the top dead center of the linear compressor based on the phase difference and generate the control signal s_con based on the detected top dead center. This compressor power control method may be referred to as a top dead center control method based on the phase difference.

The controller C100 may also detect a spring constant corresponding to the motor of the linear compressor LC100 based on the asymmetric motor current Im_asym and the detected stroke. The spring constant may refer to a spring constant Kgas based on the gas within the cylinder of the compressor motor. The controller C100 may generate the control signal such that the output power of the linear compressor can be controlled based on the spring constant. The controller may detect the top dead center of the linear compressor based on the spring constant and generate the control signal s_con based on the detected top dead center. This compressor power control method may be referred to as a top dead center control method based on the spring constant (or a gas spring constant).

Figure 9:
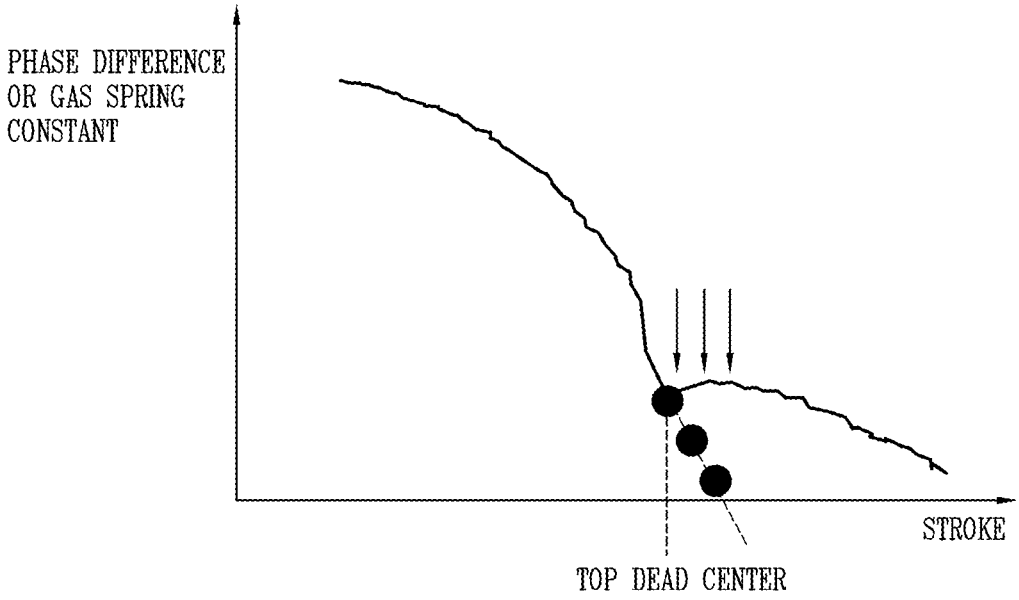
FIG. 9 is a graph illustrating a phase difference or a gas spring constant detected at every preset period according to a change in a stroke.

Hereinafter, description will be briefly given of a top dead center control method based on a phase difference or a spring constant with reference to FIG. 9, as one exemplary embodiment of the top dead center control method. FIG. 9 is a graph illustrating a phase difference or a gas spring constant detected at every preset period according to a change in a stroke.

When a phase difference and a stroke have the same phase, a change in the phase difference increases as the piston moves closer to the top dead center (i.e., a position of TDC=0). An inclination of the change in the phase difference may sharply increase as the piston moves closer to the top dead center. The phase difference may refer to a phase difference between the asymmetric motor current Im_asym and the detected stroke or the phase difference may be also based on the asymmetric motor current Im_asym and the detected motor voltage Vm.

In case of driving the linear compressor having a resonant frequency, the phase difference increases again after the top dead center is detected. In contrast, in case of driving the linear compressor according to a frequency higher than the resonant frequency, the change in the phase difference may not be predicted after the top dead center is detected.

The controller C100 may detect a phase difference at every preset period, so as to confirm that the inclination is increased. The controller C100 may set the detected phase difference as an initial reference phase difference, and then maintain the inclination on the initial reference phase difference at every period. The preset period generally indicates a reciprocating period of the motor piston, but may be set or changed by a user or the like.

The controller C100 may compare the set reference phase difference with a phase difference of a current period. When the reference phase difference is continuously reduced, a difference between the reference phase difference and a phase difference detected at every period after detection of the top dead center may be maintained over a predetermined value, regardless of the unpredictable change in the phase difference after the detection of the top dead center.

The controller C100 may determine the detected initial reference phase difference as a phase difference inflection point when the difference is detected more than a predetermined number of times over the predetermined value, and determines a position of the piston at the inflection point of the phase difference as a top dead center. The controller C100 may output a control signal s_con for driving the drive circuitry DRV100 using the detected top dead center.

A top dead center control method based on a gas spring constant is described hereinafter. When a gas spring constant and a stroke have the same phase, the change in the gas spring constant may increase in response to the piston moving close to the top dead center (TDC=0). An inclination of the change in the gas spring constant may sharply increase as the piston moves closer to the top dead center.

In case of driving the linear compressor according to a resonant frequency, the gas spring constant may increase again after the top dead center is detected. In contrast, in case of driving the linear compressor according to a frequency higher than the resonant frequency, the change in the gas spring constant may not be predicted after the top dead center is detected.

Referring to FIG. 9, the controller C100 may detect the gas spring constant at every predetermined period, so as to detect a gas spring constant with a sharp increase in inclination. The controller C100 may set the detected gas spring constant as an initial reference constant, and then maintain an inclination at the initial reference constant at every predetermined period. The predetermined period generally refers to a reciprocating motion period of the motor piston, but may be set or changed by a user or the like.

The controller C100 may compare the set reference constant with a gas spring constant of a current period. When the reference constant continuously decreases, a difference between the reference constant and the gas spring constant, which is detected for a predetermined number of periods after the detection of the top dead center, regardless of the unpredictable change in the gas spring constant after the detection of the top dead center.

The controller C100 may determine a detected initial reference constant as an inflection point of the gas spring constant when the difference is detected more than a predetermined number of times over the predetermined value, and determines a position of the piston at the inflection point of the gas spring constant as a top dead center. The controller C100 may output a control signal s_con for driving the drive circuitry DRV100 using the detected top dead center.

A calculation (computation) of the gas spring constant will be described in detail. In general, a piston is provided with various types of springs, which are installed to elastically support the piston in a motion direction of the piston even if the piston is linearly reciprocated by a linear motor.

A coil spring, which is a type of mechanical spring, may be installed on a hermetic container and a cylinder to elastically support the piston in the motion direction thereof. A refrigerant sucked into a compression space may also serve as a gas spring. The coil spring may have a predetermined mechanical spring constant Km and the gas spring may have a gas spring constant Kg which varies according to a load. A specific (unique) frequency fn of the linear compressor may be decided by taking into account the mechanical spring constant Km and the gas spring constant Kg.

In accordance with one exemplary embodiment, the controller C100 may calculate the gas spring constant according to a load of the linear compressor. The controller C100 may calculate the gas spring constant Kg based on (1) an asymmetric motor current Im_asym, (2) a stroke detected or a stroke determined based on the asymmetric motor current Im_asym and a detected motor voltage Vm, and (3) a phase difference between the asymmetric motor current Im_asym and the stroke.

For example, the spring constant Kg may be calculated by the following Equation 2.

$$K_g = \alpha\left|\frac{I(j\omega)}{X(j\omega)}\right|\cos(\theta_{i,x}) + M\omega^2 - K_m \qquad \text{[Equation 2]}$$

where, α denotes a motor constant or a counter electromotive force constant, ω denotes an operating frequency, Km denotes a mechanical spring constant, Kg denotes a gas spring constant, M denotes a mass of a piston, |I(jω)| denotes a current peak value for one period, and |X(jω)| denotes a stroke peak value for one period.

The controller C100 may set a gas spring constant, whose change is the greatest among the gas spring constants, as an initial reference constant, and set a reference constant from the initial reference constant in response to repetition of the period. The reference constant may be reduced by a changed amount at the initial reference constant as the predetermined period is repeated.

Figure 10:
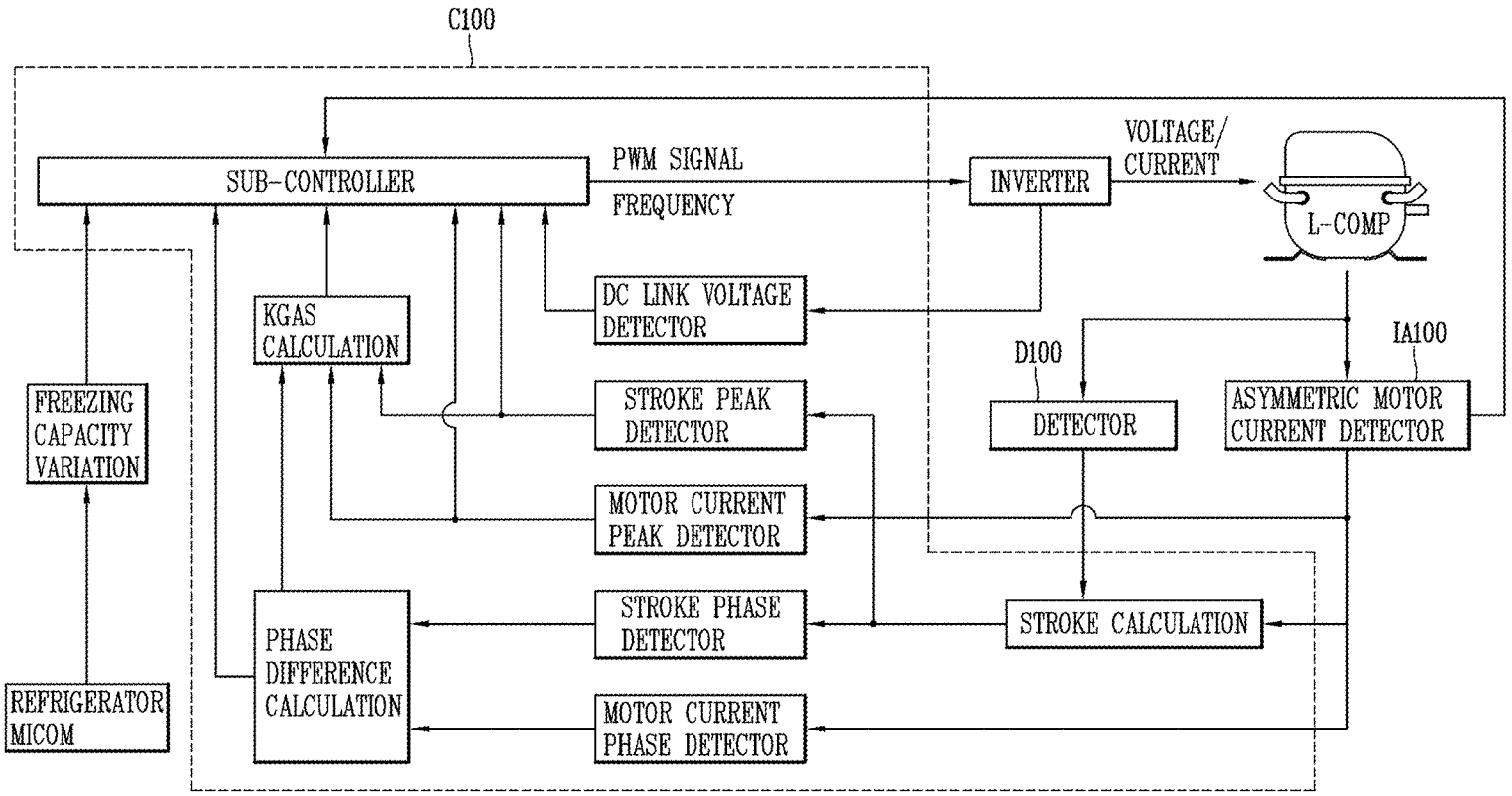
FIG. 10 is a view illustrating a detailed configuration of a controller in accordance with an embodiment disclosed herein.

FIG. 10 is a view illustrating a detailed configuration of a control module 100 in accordance with an embodiment disclosed herein. The controller C100 according to one exemplary embodiment may include a stroke calculating module, a stroke phase detector, a motor current phase detector, a stroke peak value detector, a motor current peak value detector, a phase difference calculating module, a gas spring constant calculating module (Kgas calculating module), a DC link voltage detector and a sub-controller. Those components may be implemented as a type of controller as one component, or be implemented by an on-chipped microcomputer (micom) and micro processor.

The detector D100 may detect a motor current and a motor voltage corresponding to a motor of a linear compressor L-COMP. The asymmetric motor current generator IA100 may generate an asymmetric motor current by applying a current offset to the detected motor current. The stroke calculating module may calculate a stroke based on the detected asymmetric motor current and the detected motor voltage. The stroke phase detector may detect a phase of the calculated stroke.

The motor current phase detector may detect a phase of the detected asymmetric motor current. The phase difference calculating module may calculate a difference between the phase of the calculated stroke and the phase of the detected asymmetric motor current to detect a phase difference between the stroke and the asymmetric motor current. The stroke peak value detector and the motor current peak value detector may detect a stroke peak value and an asymmetric motor current peak value, respectively, to detect a gas spring constant.

The gas spring constant calculating module (Kgas calculating module) may detect or calculate a spring constant Kgas based on the phase difference, the stroke peak value and the asymmetric motor current peak value. The gas spring constant calculating module (Kgas calculating module) may detect or calculate the gas spring constant Kgas by the aforementioned Equation 2.

The sub-controller may control the linear compressor L-COMP by controlling an inverter based on at least one of the phase difference and the gas spring constant. The sub-controller may apply a modulated PWM signal (a voltage control signal) s_con to the inverter based on at least one of the phase difference and the gas spring constant. In accordance with one exemplary embodiment, the sub-controller may be implemented as microcomputer (micom) and microprocessor, independent of each other.

The sub-controller may control a DC-DC converter and the inverter based on a DC link voltage, which is a voltage of a DC link capacitor located between the DC-DC converter and the inverter. In accordance with one exemplary embodiment, the sub-controller may carry out a resonance operation based on a virtual capacitor when there is not a capacitor (or an AC capacitor) connected to the linear compressor L-COMP. In this case, the sub-controller may carry out a capacitor voltage calculating process for implementing the virtual capacitor in a manner of directly receiving the asymmetric motor current from the detector D100.

The virtual capacitor implementing method will be described in detail later with reference to a second exemplary embodiment and FIGS. 12 to 14.

Setting of Current Offset According to Operation Mode

As aforementioned, the current offset i_offset according to the first exemplary embodiment may be decided (or changed) according to the operation mode or driving mode of the linear compressor LC100. The controller C100 may set the current offset i_offset to '0' when the operation mode is the symmetric control mode, and set the current offset i_offset to a specific value when the operation mode is the asymmetric control mode. In accordance with the first exemplary embodiment, the operation mode may be at least one of a symmetric control mode and an asymmetric control mode. The symmetric control mode and the asymmetric control mode may also mean types of operation modes of the compressor.

For example, the symmetric control mode is a mode for increasing efficiency, and thus may be referred to as a high-efficiency mode. Alternatively, the symmetric control mode is a mode in which relatively low-load or low-freezing capacity driving is carried out as compared with the asymmetric control mode, and may be referred to as a low-load or low-freezing capacity mode.

The asymmetric control mode is a mode for increasing an output and may be referred to as a high-output mode. Alternatively, the asymmetric control mode is a mode in which relatively high-load or high-freezing capacity driving is carried out as compared with the symmetric control mode and may be referred to as a high-load or high-freezing capacity mode.

Figure 11:
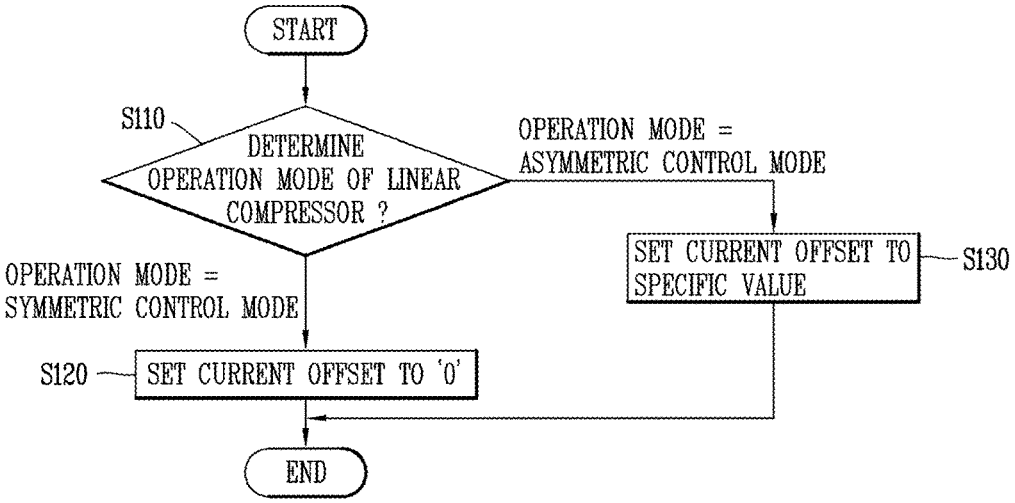
FIG. 11 is a flowchart illustrating a method of setting a current offset based on an operation mode in accordance with an embodiment disclosed herein.

FIG. 11 is a flowchart illustrating a method of setting a current offset based on an operation mode which may include the following steps.

First, the controller C100 may determine an operation mode of the linear compressor LC100 (S110).

Next, the controller C100 may set a current offset i_offset to '0' when the operation mode has been set to a symmetric control mode (S120).

The controller C100 may also set the current offset i_offset to a specific value when the operation mode has been set to an asymmetric control mode (S130).

The specific value may be decided based on a load of the linear compressor LC100 or a freezing capacity command value corresponding to the linear compressor LC100. The freezing capacity command value may be generated by a main controller of a refrigerator. The freezing capacity command value may also be a value which is decided or adjusted according to the load of the linear compressor LC100.

In accordance with one exemplary embodiment, the setting of the operation mode may be carried out by a main controller of a refrigerator (or the refrigerator micom illustrated in FIG. 10), to which the linear compressor LC100 and the control module 100 of the linear compressor are applied.

For example, the main controller of the refrigerator may set the operation mode to the symmetric control mode when the load of the compressor is smaller than a reference load or a reference freezing capacity command value (for example, 150 watts [W]). Alternatively, the main controller of the refrigerator may also set the operation mode to the asymmetric control mode when the load of the compressor is greater than the reference load or the reference freezing capacity command value (for example, 150 watts [W]).

In accordance with another exemplary embodiment, the setting of the operation mode may be carried out by the control module 100 of the linear compressor. For example, the controller C100 may set the operation mode to the symmetric control mode when the load of the compressor is smaller than the reference load or the reference freezing capacity command value (for example, 150 watts [W]). Alternatively, the controller C100 may set the operation mode to the asymmetric control mode when the load of the compressor is greater than the reference load or the reference freezing capacity command value (for example, 150[W]).

Setting of Current Offset According to Compressor Load or Freezing Capacity Command Value As described above, the current offset may be set, determined, adjusted or changed according to the load of the linear compressor LC100 or the freezing capacity command value corresponding to the linear compressor LC100. Therefore, in order to set or determine the aforementioned operation mode or current offset, the controller C100 may detect the load of the linear compressor LC100.

The controller may detect the load of the linear compressor LC100 based on at least one of an absolute value for a phase difference between a current applied to the linear compressor LC100 and a stroke, an outer temperature of the linear compressor, an inner temperature of the linear compressor LC100, and a temperature of a condenser and an evaporator within a refrigeration cycle.

The control module 100 may set the current offset i_offset to '0' when the detected load is less than (or smaller than) a first reference load such that the linear compressor LC100 can operate in the symmetric control mode. When the detected load exceeds (or is greater than) the first reference load, the control module 100 may set the current offset i_offset to a constant value or set the current offset i_offset to be increased in response to an increase in the detected load. The first reference load may be a load in the range of 150 to 250 watts [W].

In accordance with another exemplary embodiment, the current offset i_offset according to the detected load may be set by the aforementioned asymmetric motor current generator IA100. For example, when the controller C100 transfers the detected load value to the asymmetric motor current generator IA100, the asymmetric motor current generator IA100 may decide or set the current offset i_offset corresponding to the detected load using a table which stores current offset set values on the load basis.

According to a similar method, the control module 100 may set or decide the current offset based on a freezing capacity command value. For example, the control module 100 may set the current offset to '0' when a freezing capacity command value applied by the refrigerator micom is smaller than a first reference freezing capacity. The control module 100 may set the current offset i_offset to a constant value or set the current offset i_offset to be increased in response to an increase in the freezing capacity command value when the freezing capacity command value is greater than the first reference freezing capacity.

Similar to the current offset setting method according to the load, the current offset i_offset according to the freezing capacity command value may be set by the asymmetric motor current generator IA100. The controller C100 of the compressor control module 100 may control the asymmetric current generator IA100 to generate an asymmetric motor current to which the set current offset is applied.

In accordance with a variation of the first exemplary embodiment, the control module 100 may set or decide the current offset i_offset based on the motor constant (or the counter electromotive force constant) a disclosed in Equation 2.

In detail, according to the variation of the first exemplary embodiment, a piston push amount Pushioffset by the current offset i_offset may be expressed by the following Equation 3.

$$\mathrm{Push}_{I_{offset}}[\mathrm{mm}] = \frac{\alpha[N/A] \times I_{offset}[A]}{K_{spring}[N/\mathrm{mm}]} \quad \text{[Equation 3]}$$

where α: a motor constant or a counter electromotive force constant $I_{offset}$: a current offset $K_{spring}$: a spring constant In order to enhance accuracy of an asymmetric motor control, when a desired push amount is decided, the controller may estimate the motor constant α in response to driving of the compressor so as to decide a more accurate current offset $I_{offset}$.

According to the variation of the first exemplary embodiment, the motor constant α may be detected based on the stroke and the motor current Im or the asymmetric motor current Im_asym.

Therefore, the controller C100 may set the current offset Ioffset by detecting or estimating the motor constant α based on the motor current Im or the asymmetric motor current Im_asym. A push amount of a piston, which is included in a motor of the linear compressor, due to the current offset, as expressed by Equation 3, may be in proportion to a motor constant corresponding to the motor of the linear compressor and the current offset. Consequently, the controller C100 may detect the motor constant based on the stroke, the detected motor current Im or the asymmetric motor current Im_asym, and adjust the current offset based on the detected motor constant.

The variation of the first exemplary embodiment may allow for an accurate asymmetric motor control in view of setting, adjusting and deciding the current offset for accurately controlling the piston push amount through the estimation and detection of the motor constant.

Compressor Control Module with Virtual Capacitor

Another embodiment disclosed herein illustrates a compressor control module with a virtual capacitor, capable of executing an asymmetric motor control, and a control method thereof. The linear compressor may be a resonance compressor which carries out the resonance operation based on an inductor corresponding to a motor and a virtual capacitor.

A control module of a linear compressor according to a second exemplary embodiment disclosed herein may include a drive circuitry which drives the linear compressor based on a control signal, a detector which detects a motor current and a motor voltage corresponding to a motor of the linear compressor, an asymmetric current generator which generates an asymmetric motor current by applying a current offset to the detected motor current, and a controller which generates the control signal based on the asymmetric motor current and the detected motor voltage.

The controller may integrate the asymmetric motor current, calculate a capacitor voltage by multiplying the integrated value by a specific constant value, and implement a function of the virtual capacitor by generating the control signal based on the calculated capacitor voltage. The control signal may be a voltage control signal which is generated by a pulse width modulation (PWM), and the controller may generate the voltage control signal based on the determined capacitor voltage.

The controller may generate a changed PWM reference signal by subtracting the calculated capacitor voltage from a PWM reference signal of a sine wave type for adjusting a pulse width of the voltage control signal, and generate the voltage control signal based on the changed PWM reference signal.

A capacitance of the virtual capacitor may be in inverse proportion to the specific constant. The virtual capacitor modulation according to this embodiment may refer to implementing in a software manner a physically existing capacitor voltage within a micom, a controller or the controller C100. Referring to FIG. 10, the sub-controller may implement a function of the virtual capacitor, which implements a real capacitor in a software configuration, based on the asymmetric motor current Im_asym.

A motor control by the virtual capacitor may be carried out in order to provide the same control function as an existing capacitor in absence of a physical capacitor, i.e., hardware implementation.

In general, a linear compressor may be a resonance compressor which carries out a resonance operation based on an inductor corresponding to the motor and a capacitor (AC capacitor) connected to the motor. By removing a real capacitor (AC capacitor) connected to the motor, the controller C100 may then carry out the virtual capacitor function, implemented in the software configuration, corresponding to the real capacitor.

Figure 12:
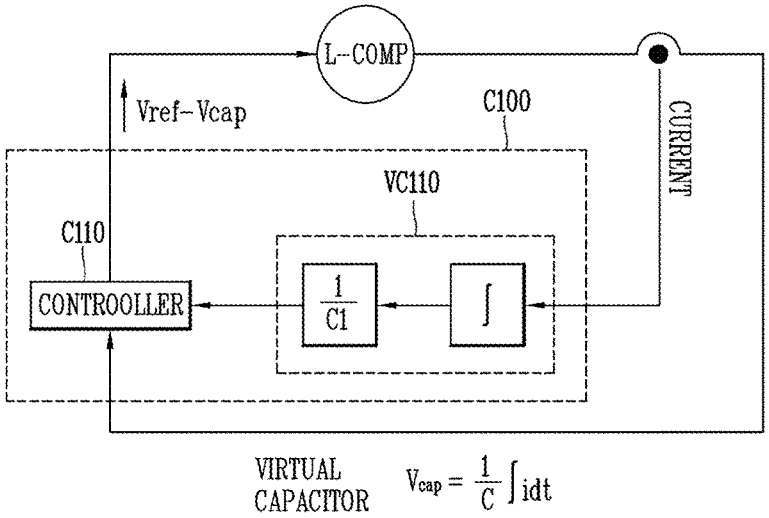
FIG. 12 illustrates a virtual capacitor control.

FIG. 12 illustrates a virtual capacitor control. The controller C100 of FIGS. 3 and 10 may further include a virtual capacitor VC110 based on a prescribed algorithm or software (stored on a readable media) with a controller C110. The virtual capacitor VC110 may be based on an integrator which integrates a detected motor current, and a multiplier which multiplies the integrated value of the integrator by a specific constant. The specific constant is a value corresponding to an inverse number of a desired capacitance of the virtual capacitor, but may be changed according to a computing method.

In accordance with this embodiment, the value obtained by multiplying the integrated value with respect to the asymmetric motor current Im_asym by the specific constant may be a virtual capacitor voltage Vcap which is a determined output voltage of the virtual capacitor. The subcontroller C110 may generate, as a new reference voltage, a voltage difference, which is obtained by subtracting the virtual capacitor voltage Vcap from a reference voltage Vref for generating the control signal s_con. When the control signal is generated in the aforementioned PWM manner, the reference voltage Vref may correspond to the reference signal Vr illustrated in FIG. 4B.

Figure 13:
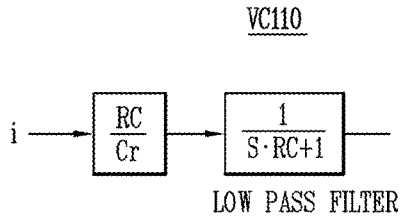
FIG. 13 is a configuration view in a frequency area of the virtual capacitor.

FIG. 13 is a configuration view in a frequency area of the virtual capacitor. As illustrated in FIG. 13, the virtual capacitor VC110 may include a low pass filter (LPF) which carries out an integration, and a component which multiplies a specific constant RC/Cr. RC denotes a multiplied value of resistance and capacitance associated with a cut-off frequency (or a time constant) of the low pass filter, and Cr denotes the desired capacitance value of the virtual capacitor. Description will be given of the need of applying the virtual capacitor for the asymmetric motor control according to this embodiment.

An aspect for applying the virtual capacitor for the asymmetric motor control is to facilitate the current offset to be applied to the detected motor current Im for the asymmetric control, in such a manner of removing an AC capacitance of a motor in a linear compressor. Upon the existence of the AC capacitance, only an AC element of compressor motor current elements is allowed to pass. Accordingly, in order to facilitate the current offset i_offset as a DC component to be applied, the function of the virtual capacitor VC100 may be necessary to be applied instead of the real AC capacitor.

By virtue of the application of the virtual capacitor VC110, the linear compressor may carry out an LC resonance (electric resonance) operation according to an operating frequency so as to be controlled within an unstable area. When the operating frequency changes based on an LC resonant frequency, the linear compressor may enter an unstable control area in which an output is unstably changed according to an applied voltage if the operating frequency is considerably greater or smaller than the LC resonant frequency. The compressor control module according to this embodiment may carry out the function of the virtual capacitor VC110 to adjust the LC resonant frequency according to the operating frequency, thereby controlling the linear compressor not to operate within an unstable control area.

The application of the virtual capacitor VC110 may also allow for a compressor control of high efficiency. For the high-efficiency compressor control, it may be preferable that the operating frequency, the mechanical resonant frequency and the electric resonant frequency of the compressor may be ideally the same.

A general linear compressor may include a mechanical resonant frequency, which is decided based on a spring constant, a mass of a movable member within the compressor, and the like, and an electric resonant frequency by an inductor corresponding to a compressor motor and an AC capacitor connected to the compressor motor. However, the general linear compressor may have a difficulty in adjusting the capacitance of the AC capacitor according to the mechanical resonant frequency or the operating frequency during an operation of the compressor, which may arouse a difficulty in high-efficiency compressor control.

Therefore, the compressor control module according to this embodiment may control the operating frequency of the compressor to track the mechanical resonant frequency. The compressor control module may allow for a high-efficiency compressor control by adjusting the capacitance of the virtual capacitor VC110 to correspond to the change in the operating frequency due to the change in the mechanical resonant frequency during the operation of the compressor in such a manner of removing the AC capacitor and applying the virtual capacitor VC110.

The mechanical resonant frequency may refer to as an MK resonant frequency. The MK resonant frequency may be defined by a mass (M) of a movable member comprising a piston and a permanent magnet, and a spring constant (K) of springs supporting the movable member.

The movable member may be supported by mechanical springs at both sides thereof based on a linearly moving direction with respect to a fixed member comprising a cylinder and stators. Therefore, the controller C100 may calculate an MK resonant frequency which is defined by the mass (M) of the movable member, and the spring constant (K) of the supporting springs.

The controller C100 may also optimize the efficiency of the linear compressor LC100 by controlling the drive circuitry DRV100 such that a frequency of power applied to the linear motor (or a driving frequency, or an operating frequency from the perspective of the compressor motor) tracks the MK resonant frequency. In order to ensure optimality for the efficiency of the linear compressor LC100, an electric resonant frequency, which is based on an inductor corresponding to the linear motor and a capacitor (or an AC capacitor) included in or connected to the linear motor, may preferably track the operating frequency. However, a physical capacitor included in or connected to the linear motor may be difficult to adjust and control the capacitance.

A virtual capacitor may be utilized to control a linear compressor to provide a control function where the electric resonant frequency can be controlled to track the operating frequency. The capacitance of the virtual capacitor can be adjusted when the operating frequency changes according to the mechanical resonant frequency.

In other words, the controller C100 may control the operating frequency of the linear compressor LC100 to track the mechanical resonant frequency of the linear compressor LC100. When the operating frequency is adjusted due to the change in the mechanical resonant frequency the controller C100 may adjust the specific constant during the operation of the linear compressor LC100. Based on such an adjustment, the electric resonant frequency, which is based on the inductor corresponding to the motor and the virtual capacitor, tracks the adjusted operating frequency.

The adjustment of the specific constant may result in the adjustment of the capacitance of the virtual capacitor, which may allow the linear compressor to have optimal efficiency. A compressor having such a control module may have a reduced fabricating cost due to an absence of a physical AC capacitor.

Figure 14:
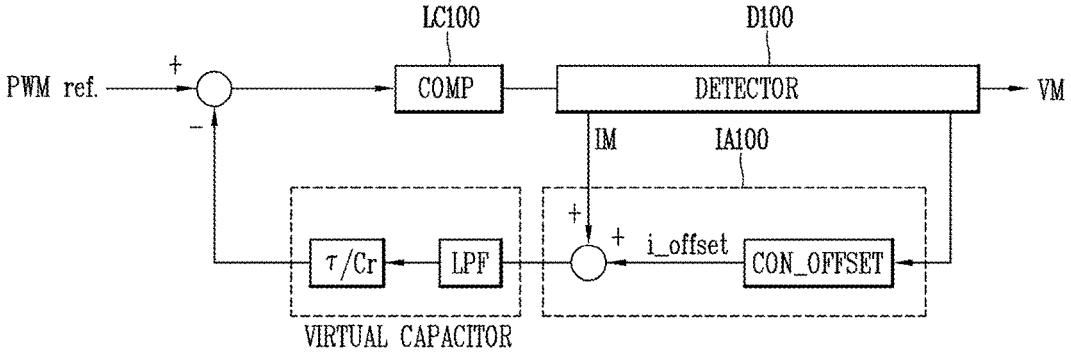
FIG. 14 illustrates a control module, which executes an asymmetric control by employing a virtual capacitor, in accordance with an embodiment disclosed herein.

FIG. 14 is a control module incorporated into the device of FIGS. 3 and 10, which executes an asymmetric control by employing a virtual capacitor, in accordance with this embodiment. The asymmetric motor current generator IA100 may provide the asymmetric motor current Im_asym in a manner of applying or combining the current offset i_offset to the motor current Im detected from the linear compressor LC100 which does not have a physical AC capacitor.

The virtual capacitor VC100 may allow the asymmetric motor current Im_asym to pass through the low pass filter LPF, and multiply a specific constant (where $\tau$ is a time constant related to a cut-off frequency of the LPF) to generate a virtual capacitor voltage (corresponding to the aforementioned Vcap). The compressor control module 100 may generate a new reference voltage by combining or subtracting the virtual capacitor voltage from a reference signal PWM ref (corresponding to the aforementioned Vref) for generating a PWM control signal s_con, which is used to drive the drive circuitry DRV100.

Control of the Number of Turns of Motor Coil for Overload Management

In case where a virtual capacitor previously is applied, the shortage of voltage applied to the motor of the linear compressor may be caused due to the overload of the compressor. The control module 100 according to this embodiment may selectively reduce the number of turns of a motor coil when the compressor is overloaded so as to overcome the shortage of voltage applied to the motor. The overload may refer to a load greater than a high load using asymmetric control mode.

The compressor control module 100 according to this exemplary embodiment may increase efficiency of the linear compressor by increasing the number of turns of the motor coil in a normal state (or in a general load state, other than an overload state, or the high-efficiency mode), in such a manner that the coil corresponding to the motor can be the coil in the form of selectively combining the first coil and the second coil. The control module 100 may also prevent the shortage of the voltage applied to the motor by reducing the number of turns of the motor coil in an overload state (or in the overload management mode) in such a manner that the coil corresponding to the motor can be the first coil.

The control module 100 of the linear compressor controls the linear compressor LC100 in the high-load state to output a maximum freezing capacity by carrying out an asymmetric control. The control module 100 controls the linear compressor in the overload state to prevent the shortage of the voltage applied to the motor by reducing the number of turns of the motor coil. The compressor control method by way of controlling the number of turns of the motor coil may be 2-tap control of the motor coil.

Figure 15:
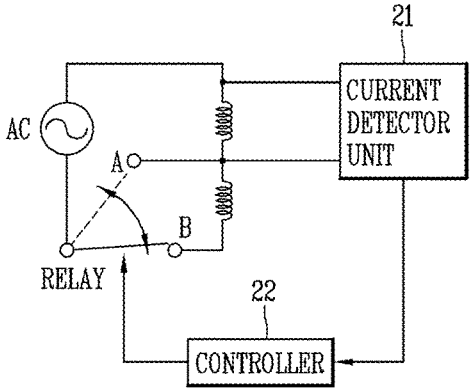
FIG. 15 is an exemplary view illustrating one example of a control module in accordance with an embodiment disclosed herein.

FIG. 15 is an exemplary view illustrating a control module in accordance with another embodiment which can be implemented in the control module of FIGS. 3 and 10.

A controller 22 outputs a switching control signal, which varies a capacity, based on a current detected by a current detector 21, which detects a current of the motor. A switching element (for example, a relay) switches a flow of current to the first coil or to the first and second coils of the motor according to the switching control signal.

In operation, initial driving of the linear compressor may be carried out in a high-efficiency mode, in which a motor is driven by receiving (AC) power through the first and second coils based on an off-state relay in contact with a point B by an output control signal of the controller 22. For example, the high-efficiency mode may include the symmetric and asymmetric control modes previously described.

The controller 22 may recognize a current zone as an overload state when the current detector 21 detects, a current dead zone exhibiting a current of '0' being maintained for less than a predetermined time among currents applied to the motor. Upon such a detection, the controller 22 may output an overload management switching signal to the relay. The relay may carry out switching of 'high-efficiency mode' to 'overload management mode,' namely, from point B to point A, thereby reducing the number of turns from the first and second coils to the first coil to avoid the voltage shortage.

The overload management mode may refer to a compressor driving mode when the load of the compressor is greater than the high load of the asymmetric control mode. A voltage may be compensated to prevent a deficient voltage, and the controller 22 may readily recognize the overload state when a current dead zone in which the motor current is '0' for more than a predetermined time. The deficient voltage may correspond to the shortage of voltage applied to the motor of the compressor due to the overload state of the compressor motor.

The overload management mode ensures sufficient current to be applied to the motor to manage the overload. The overload state may refer to a case where the compressor load is over 300 watts [W].

The overload state may be detected based on the motor current detected by the current detector 21 as illustrated in FIG. 15. However, the overload state may also be detected by other load detecting methods. For example, the overload management mode corresponding to the operation mode or the driving mode of the compressor may be decided based on the load of the linear compressor or the freezing capacity command value corresponding to the linear compressor.

The overload management mode may be also an operation mode or driving mode of the compressor which may be activated when the voltage shortage is detected. The control module may further include a sensor (for example, a compressor motor voltage sensor) to detect the voltage shortage.

The detection of the overload state may be determined based on at least one of an absolute value for a phase difference between a current applied to the linear compressor and a stroke, an outer temperature of the linear compressor, an inner temperature of the linear compressor, and a temperature of a condenser and an evaporator within a refrigeration cycle.

Figure 16:
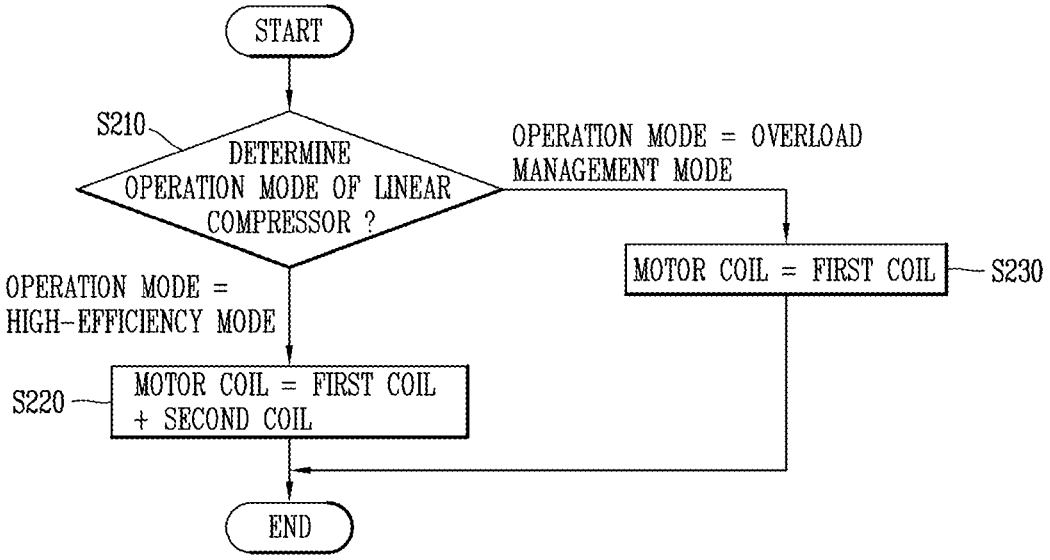
FIG. 16 is a flowchart illustrating a compressor control method in accordance with an embodiment disclosed herein.

FIG. 16 is a flowchart illustrating a compressor control method in accordance with this embodiment. Initially, a compressor control module 100 may determine an operation mode or driving mode of a linear compressor (S210). the compressor control module 100 may increase the number of turns of a motor coil in such a manner that a coil corresponding to the motor can be a coil in a form of selectively combining a first coil and a second coil when the driving mode is a high-efficiency mode (S220). The compressor control module 100 may also prevent a shortage of voltage applied to the motor by reducing the number of turns of the motor coil in such a manner that the coil corresponding to the motor can be the first coil when the driving mode is an overload management mode (S230).

Control of Compressor Based on Compressor Load Change

Figure 17:
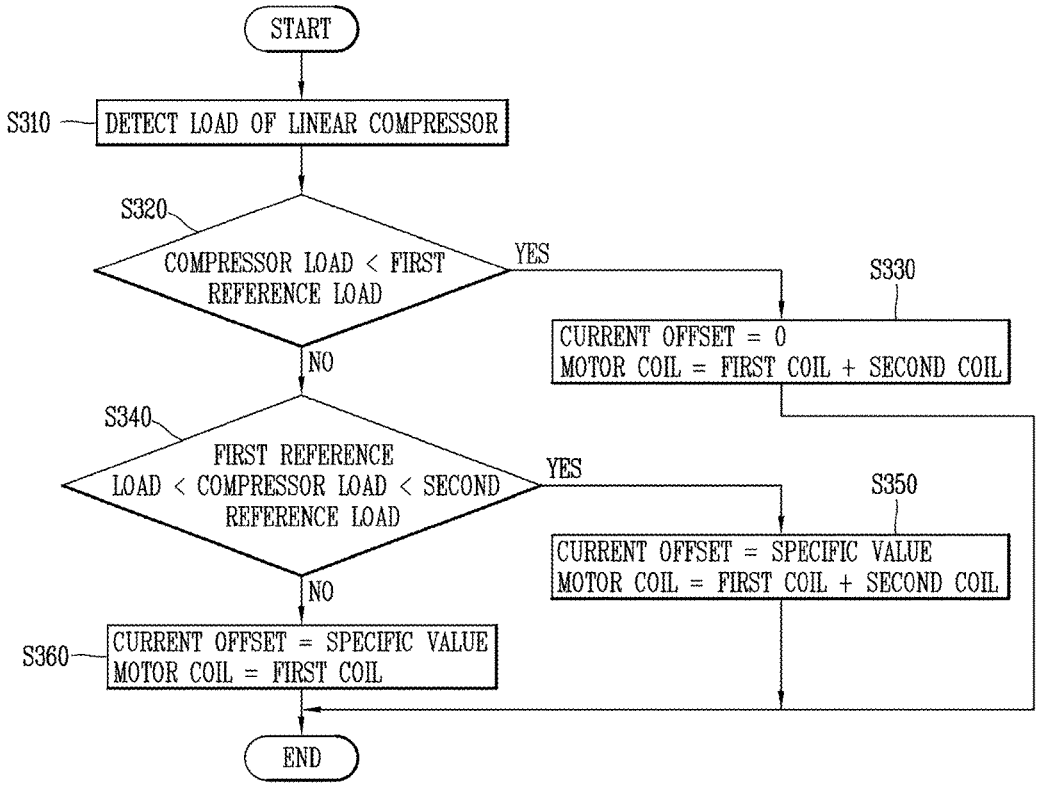
FIG. 17 is a flowchart illustrating a compressor control method in accordance with an embodiment disclosed herein.

FIG. 17 is a flowchart illustrating a compressor control method in accordance with another embodiment. The compressor control method according to the fourth exemplary embodiment may include the following steps.

Initially, the control module 100 may detect a load of a linear compressor LC100 (S310). The control module 100 may set the current offset i_offset to '0' when the compressor load is smaller than a first reference load (a first condition, corresponding to the high-efficiency mode or the symmetric control mode), and control the switching element such that the motor coil of the compressor may be a combination of the first coil and the second coil (S320 and S330).

Afterwards, the control module 100 may set the current offset i_offset to a specific value when the compressor load is greater than the first reference load and smaller than a second reference load (a second condition, corresponding to the high-load mode or the asymmetric control mode). In this case, the control module 100 may control the switching element such that the motor coil of the compressor may be a combination of the first coil and the second coil. When the motor coil of the compressor has already been previously set to the combination of the first coil and the second coil, the state of the switching element may be maintained (S340 and S350).

The control module 100 may set the current offset i_offset to a specific value when the compressor load is greater than a third reference load (a third condition, corresponding to the overload management mode), and controls the switching element such that the motor coil of the compressor corresponds to the first coil (S360). The third reference load may be the same as or greater than the second reference load.

When the third reference load is greater than the second reference load, the compressor control module 100 may set the current offset i_offset to the specific value by recognizing as the third condition only a case where the compressor load is greater than the third reference load which is greater than the second reference load, even though the compressor load is greater than the second reference load. The compressor control module 100 may then control the switching element such that the motor coil of the compressor can be the first coil. Here, the third reference load may be a reference load which is specifically set for an entrance into the overload management mode (or for determination of the overload state).

In accordance with the fourth exemplary embodiment, the third reference load may be smaller than the second reference load.

When the third reference load is smaller than the second reference load, the compressor control module 100 may carry out, in the third condition, the setting of the current offset to '0,' which is the control condition in the first condition, or the maintaining of the existing current offset value, which is a control condition in the second condition. Along with this, the compressor control module 100 may control the switching element such that the motor coil of the compressor can be the first coil.

In accordance with the fourth exemplary embodiment, the specific value may be decided based on the load of the linear compressor or a freezing capacity command value corresponding to the linear compressor, Also, the compressor control module 100 according to the fourth exemplary embodiment may adjust the current offset illustrated in FIG. 17 and the number of turns of the motor coil according to the operation mode or driving mode of the linear compressor LC100.

Here, the driving mode may include at least one of a symmetric control mode, an asymmetric control mode, a high-efficiency mode and an overload management mode.

The driving modes may be separate operation modes from one another, operation modes corresponding to each other, or operation modes part of which are separate from each other or correspond to each other.

For example, when the operation modes are separate from each other, the operation mode corresponding to one point during the operation of the linear compressor LC100 may be in plurality.

In detail, the controller C100 may set the current offset to '0' when the operation mode is the symmetric control mode and the high-efficiency mode, and generate the switching control signal such that the coil corresponding to the motor can be the coil in the form of selectively combining the first coil and the second coil.

Also, when the operation mode is the asymmetric control mode and the high-efficiency mode, the controller C100 may set the current offset value to a specific value, and generate the switching control signal such that the coil corresponding to the motor can be the coil in the form of selectively combining the first coil and the second coil.

When the operation mode is the asymmetric control mode and the overload management mode, the controller C100 may set the current offset to a specific value and generate the switching control signal such that the coil corresponding to the motor can be the first coil.

Also, for example, when the operation modes are corresponding to each other, the operation mode corresponding to one point during the operation of the linear compressor LC100 may be one.

In detail, for example, when the operation mode is the symmetric control mode or a first high-efficiency mode, the controller C100 may set the current offset to '0' and generate the switching control signal such that the coil corresponding to the motor can be the coil in the form of selectively combining the first coil and the second coil.

Also, when the operation mode is the asymmetric control mode or a second high-efficiency mode, the controller C100 may set the current offset to a specific value and generate the switching control signal such that the coil corresponding to the motor can be the coil in the form of selectively combining the first coil and the second coil.

Here, the first high-efficiency mode and the second high-efficiency mode refer to a high-efficiency mode in a narrow sense, respectively, and may be separate operation modes for distinguishing operation modes associated with the symmetric or asymmetric control mode. Strictly speaking, the high-efficiency mode in the narrow sense may refer to only the first high-efficiency mode.

Also, the first high-efficiency mode and the second high-efficiency mode may refer to a high-efficiency mode in a broad sense.

Also, when the operation mode is the asymmetric mode or the overload management mode, the controller C100 may set the current offset to a specific value and generate the switching control signal such that the coil corresponding to the motor can be the first coil.

For example, when some of the operation modes are corresponding to or separate from each other, the operation mode corresponding to one point during the operation of the linear compressor LC100 may be one or in plurality.

In detail, as one example, when the operation mode is the symmetric control mode, the controller C100 may set the current offset to '0' and generate the switching control signal such that the coil corresponding to the motor can be the coil in the form of selectively combining the first coil and the second coil.

When the operation mode is the asymmetric control mode, the controller C100 may set the current offset to a specific value and generate the switching control signal such that the coil corresponding to the motor can be the coil in the form of selectively combining the first coil and the second coil.

When the driving mode is the overload management mode, the controller C100 may generate the switching control signal such that the coil corresponding to the motor can be the first coil.

In accordance with one exemplary embodiment, the driving mode may be a driving mode which is associated with the load of the linear compressor, the freezing capacity command value or a motor voltage shortage state.

For example, from the perspective of the load of the linear compressor, the symmetric control mode may correspond to a high-efficiency driving mode in a load condition similar to the first condition (or a high-efficiency driving mode in a narrow sense), and the asymmetric control mode may correspond to a high-load driving mode in a load condition similar to the second condition. The overload management mode may be a driving mode in a load condition similar to the third condition.

Here, the high-efficiency mode according to FIG. 15 and the third exemplary embodiment refers to the high-efficiency mode in the broad sense, and may include the symmetric control mode and the asymmetric control mode.

The high-efficiency mode in a narrow sense may refer to only the symmetric control mode.

Besides, it will be obvious to a skilled person in this art that a combination of various operation modes or driving modes may be applied to the linear compressor control module according to the one exemplary embodiment disclosed herein.

The setting of the operation mode may be carried out by a refrigerator micom or set by the compressor control module 100 itself.

When the operation mode is set by the compressor control module 100 itself, as aforementioned, the compressor control module may detect the compressor load and decide the driving mode according to the condition of the compressor load (for example, the aforementioned first to third conditions).

In detail, for example, under the assumption that the first reference load is 150 [W] and the second reference load is 250 [W], the compressor control module 100 may set the current offset to '0' when the compressor load is 100 [W] and control the switching element such that the motor coil of the compressor can be the coil in the combination form of the first coil and the second coil.

When the compressor load is 200 [W], the compressor control module 100 may set the current offset i_offset to a specific value and control the switching element such that the motor coil of the compressor can be the coil in the combination form of the first coil and the second coil.

Also, when the compressor load is 400 [W], the compressor control module 100 may set the current offset i_offset to a specific value and control the switching element such that the motor coil of the compressor can be the first coil.

In a motor which is generally applied to a compressor, a winding coil is wound on a stator and a magnet is installed on a mover such that the mover can perform a rotary motion or a reciprocating motion by an interaction between the winding coil and the magnet. The winding coil may be formed in various shapes according to a type of motor. For example, for a rotational motor, a coil may be wound on a plurality of slots, which are formed on an inner circumferential surface of the stator along a circumferential direction, in a concentrated or distributed manner. For a reciprocal motor, a coil may be rolled into an annular shape to form a winding coil and a plurality of core sheets may be inserted into an outer circumferential surface of the winding coil along a circumferential direction. For the reciprocal motor, since the winding coil is formed by winding the coil into the annular shape, the winding coil is generally formed by winding the coil onto an annular bobbin which is made of plastic.

Figure 18:
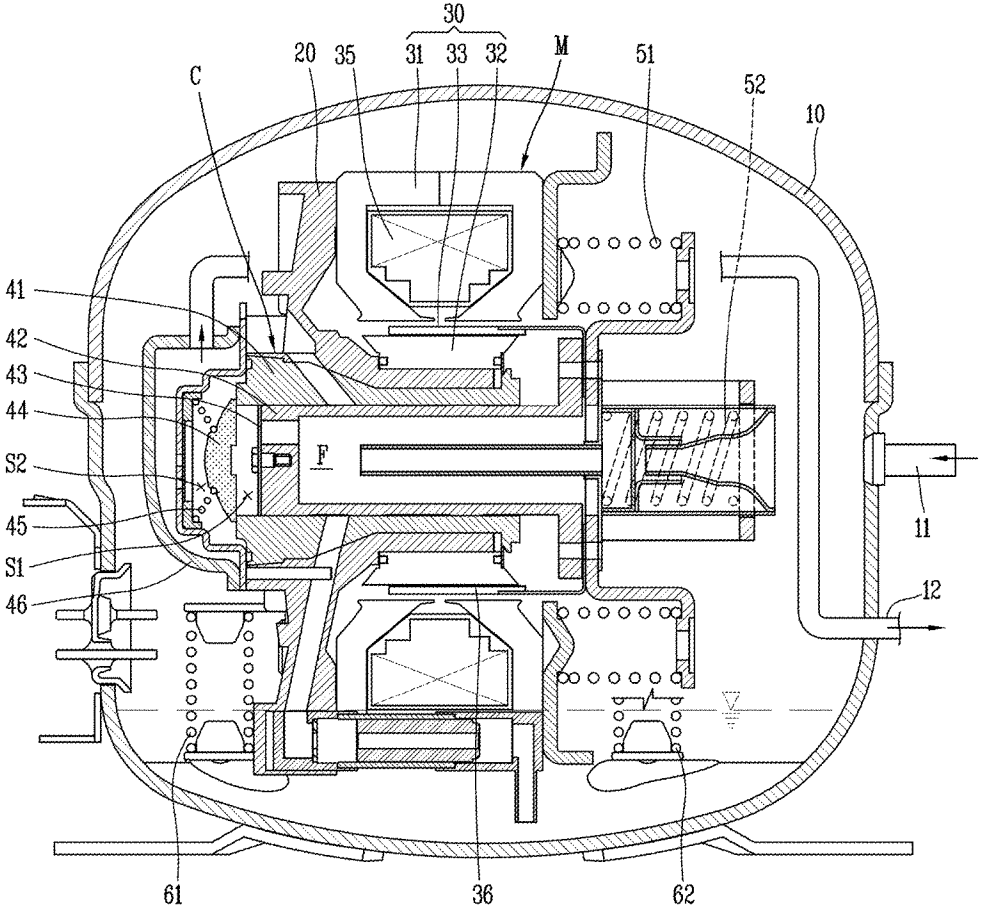
FIG. 18 is a sectional view of a linear compressor.
Figure 19:
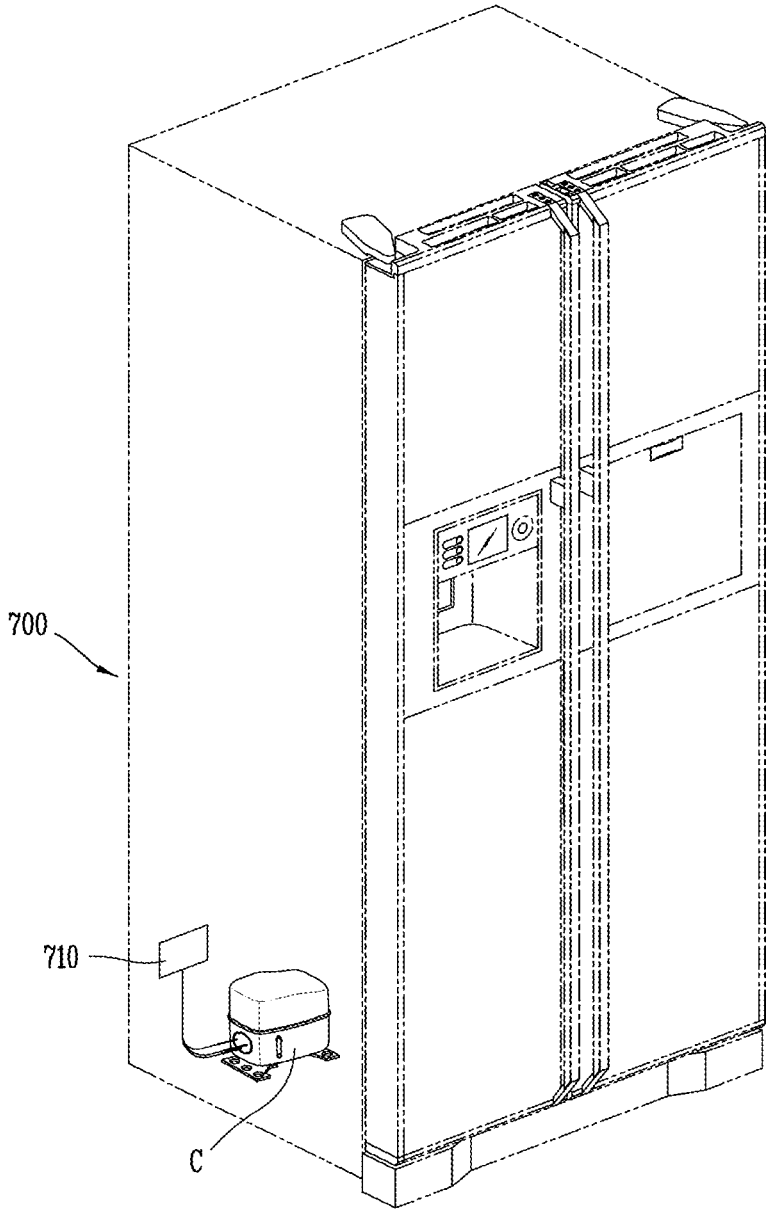
FIG. 19 is a perspective view of a refrigerator.

FIG. 18 is a sectional view of a linear compressor shown in FIG. 19. A reciprocating compressor may include a frame 20 which is elastically installed in an inner space of a hermetic shell 10 by a plurality of support springs 61 and 62. A suction pipe 11 which is connected to an evaporator of a refrigeration cycle may be installed in the inner space of the shell 10 in a communicating manner, and a discharge pipe 12 which is connected to a condenser (not illustrated) of the refrigeration cycle may be installed at one side of the suction pipe 11 to communicate with the suction pipe 11.

An outer stator 31 and an inner stator 32 of a reciprocal motor 30 which defines a motor part M may be fixed to the frame 20, and a mover 33 which performs a reciprocating motion may be installed between the outer stator 31 and the inner stator 32. A piston 42 which forms a compression part C together with a cylinder 41 to be explained later may be coupled to the mover 33 of the reciprocal motor 30 so as to perform a reciprocating motion.

The cylinder 41 may be installed within a range overlapping the stators 31 and 32 of the reciprocal motor 30 in an axial direction. A compression space S1 may be formed in the cylinder 41, and a suction passage F which guides a refrigerant into the compression chamber S1 may be formed in the piston 42. A suction valve 43 which opens and closes the suction passage F may be installed at an end of the suction passage F, and a discharge valve 44 which opens and closes the compression space S1 of the cylinder 41 may be installed at an end surface of the cylinder 41.

A plurality of resonance springs 51 and 52 which induce a resonant motion of the piston 42 may be installed at both sides of the piston 42 in the motion direction of the piston 42, respectively. Reference numeral 35 denotes a winding coil, 36 denotes a magnet, 45 denotes a valve spring, and 46 denotes a discharge cover.

When power is applied to the coil 35 of the reciprocal motor 30, the mover 33 of the reciprocal motor 30 may perform a reciprocating motion. Accordingly, the piston 42 coupled to the mover 33 may perform the reciprocating motion at high speed within the cylinder 41 such that the refrigerant can be introduced into the inner space of the shell 10 through the suction pipe 41. The refrigerant within the inner space of the shell 10 may then be introduced into the compression space S1 of the cylinder 41 through the suction passage F of the piston 42, and then discharged from the compression space S1 when the piston 42 is moved forward so as to flow toward a condenser of a refrigeration cycle through the discharge pipe 12. The series of processes may be repeated.

The outer stator 31 may be formed in such a manner of radially laminating a plurality of thin half stator cores, which are formed in a shape similar to '⊏' to be symmetrical in left and right directions, on both left and right sides of the winding coil 35. Accordingly, the outer stator 31 may have a form that the neighboring core sheets 31*a* come in contact with each other on both sides of an inner circumferential surface thereof and spaced from each other by a predetermined gap t at both sides of an outer circumferential surface thereof.

Details of linear compressors applicable to the present disclosure are disclosed in U.S. patent application Ser. No. 14/280,825 filed on May 19, 2014, U.S. patent application Ser. Nos. 14/316,908, 14/317,172, 14/317,041, 14/317,217, 14/317,218, 14/317,120 and 14/317,336 filed on Jun. 27, 2014, whose entire disclosures are incorporated herein by reference.

FIG. 19 is a perspective view of a refrigerator. A refrigerator 700 may include a main board 710 which controls an overall operation of the refrigerator, and be connected with a reciprocating compressor C. The control module and a three-phase motor driving device may be provided on the main substrate 710. The refrigerator 700 may operate as the reciprocating compressor is driven. Cooling air supplied into the refrigerator may be generated by heat-exchange of a refrigerant, and the refrigerant may be continuously supplied into the refrigerator through repetition of compression-condensation-expansion-evaporation. The supplied refrigerant may be evenly transferred into the refrigerator by a convection current such that foods can be kept in the refrigerator at a desired temperature.

As described above, in a control module of a linear compressor and a control method thereof in accordance with one exemplary embodiment disclosed herein, an optimal freezing capacity may be increased by way of basically setting a small initial position (or a small initial value) of a piston and electrically moving the initial value of the piston in a high-load driving area (i.e., controlling a piston push amount). This may result in ensuring control stability and optimizing efficiency of the compressor.

Also, in a control module of a linear compressor and a control method thereof in accordance with one exemplary embodiment disclosed herein, a virtual capacity may be applied so as to facilitate an asymmetric control based on a current offset. Also, by virtue of the application of the virtual capacitor, the linear compressor may carry out an LC resonant operation according to an operating frequency so as to be controlled in an unstable area. This may result in enabling a high-efficiency compressor control and reducing a fabricating cost.

In addition, in a control module of a linear compressor and a control method thereof in accordance with one exemplary embodiment disclosed herein, a shortage of voltage applied to a compressor motor under an overload state can be solved by a 2-tap control of reducing the number of turns of a motor coil in the overload state.

A device and method for controlling a linear compressor is capable of increasing a maximum freezing capacity by appropriately (or optimally) designing (setting) an initial value of a piston in a driving area or an operation area (or a high-efficiency driving area) of a compressor by considering the efficiency aspect, and executing an asymmetric operation in a high-load driving area (or a high freezing capacity y driving area).

A device and method for controlling a linear compressor is capable of setting an initial value which ensures stability and optimized efficiency of the compressor, by electrically moving an initial value of a piston in a high-load driving area to increase a maximum freezing capacity by setting a small initial position of the piston and supplying an asymmetric motor current to a motor controller by applying a current offset to a motor current sensed using a motor control technology.

A control module of a linear compressor includes a driving module that is configured to drive the linear compressor based on a control signal, a detector that is configured to detect a motor current corresponding to a motor of the linear compressor, an asymmetric current generator that is configured to generate an asymmetric motor current by applying a current offset to the detected motor current, and a controller that is configured to generate the control signal based on the asymmetric motor current.

The detector may detect a motor voltage corresponding to the motor of the linear compressor, and the controller may generate the control signal based on the asymmetric motor current and the detected motor voltage.

A push amount of a piston included in the motor of the linear compressor due to the current offset may be in proportion to a motor constant corresponding to the motor of the linear compressor and the current offset, and the controller may detect the motor constant based on the detected motor current or the asymmetric motor current, and adjusts the current offset based on the detected motor constant.

A control module of a linear compressor according to exemplary embodiments may include a driving module that drives the linear compressor based on a control signal, a detector that detects a motor current and a motor voltage corresponding to a motor of the linear compressor, an asymmetric current generator that generates an asymmetric motor current by applying a current offset to the detected motor current, and a controller that generates the control signal based on the asymmetric motor current and the detected motor voltage.

The current offset may be changed according to an operation mode of the linear compressor.

The operation mode may be at least one of a symmetric control mode and an asymmetric control mode.

In accordance with one exemplary embodiment, the operation mode may be decided based on a load of the linear compressor or a freezing capacity command value (or instruction value) corresponding to the linear compressor.

In accordance with one exemplary embodiment, the controller may set the current offset to '0' when the operation mode is the symmetric control mode, and set the current offset to a specific value when the operation mode is the asymmetric control mode.

In accordance with one exemplary embodiment, the specific value may be decided based on the load of the linear compressor or the freezing capacity command value corresponding to the linear compressor.

In accordance with one exemplary embodiment, the current offset may be changed according to the change in the load of the linear compressor or the freezing capacity command value corresponding to the linear compressor.

In accordance with one exemplary embodiment, the controller may detect the load of the linear compressor, set a current offset corresponding to the detected load, and control the asymmetric current generator to generate an asymmetric motor current to which the set current offset is applied.

In accordance with one exemplary embodiment, the detection of the load of the linear compressor may be carried out based on at least one of an absolute value for a phase difference between a current applied to the linear compressor and a stroke, an outer temperature of the linear compressor, an inner temperature of the linear compressor, and a temperature of a condenser and an evaporator within a refrigeration cycle.

In accordance with one exemplary embodiment, the controller may set the current offset to '0' when the detected load is below a first reference load.

In accordance with one exemplary embodiment, the controller may set a current offset corresponding to the freezing capacity command value, and control the asymmetric current generator to generate an asymmetric motor current to which the set current offset is applied.

In accordance with one exemplary embodiment, the controller may set the current offset to '0' when the freezing capacity command value is below a first reference freezing capacity.

In accordance with one exemplary embodiment, the linear compressor may be a resonance compressor which carries out a resonance operation based on an inductor corresponding to the motor and a virtual capacitor. Here, the controller may integrate the asymmetric motor current, calculate a capacitor voltage by multiplying the integrated value by a specific constant value, implement a function of the virtual capacitor in a manner of generating the control signal based on the calculated capacitor voltage.

In accordance with one exemplary embodiment, the control signal may be a voltage control signal which is generated by a pulse width modulation (PWM) method. Here, the controller may generate the voltage control signal based on the calculated capacitor voltage.

In accordance with one exemplary embodiment, the controller may generate a changed PWM reference signal by subtracting the calculated capacitor voltage from a PWM reference signal of a sine wave type for adjusting a pulse width of the voltage control signal, and generate the voltage control signal based on the changed PWM reference signal.

In accordance with one exemplary embodiment, capacitance of the virtual capacitor may be in inverse proportion to the specific constant.

In accordance with one exemplary embodiment, the controller may detect a stroke based on the asymmetric motor current and the detected motor voltage, and generate the control signal based on the detected stroke.

In accordance with one exemplary embodiment, the controller may compare a stroke command value (or a stroke instruction value) with the detected stroke, and generate the control signal based on the comparison result.

In accordance with one exemplary embodiment, the controller may detect a phase difference between a phase of the asymmetric motor current and a phase of the detected stroke.

The controller may generate the control signal such that output power of the compressor can be controlled based on the phase difference. Or, the controller may detect a top dead center of the linear compressor based on the phase difference, and generate the control signal based on the detected top dead center.

In accordance with one exemplary embodiment, the controller may detect a phase difference between a phase of the asymmetric motor current and a phase of the detected stroke, and detect a spring constant corresponding to the motor of the linear compressor based on the phase difference, the asymmetric motor current and the detected stroke. The controller may generate the control signal such that output power of the linear compressor can be controlled based on the spring constant, or detect a top dead center of the linear compressor based on the spring constant and generate the control signal based on the detected top dead center.

In accordance with one exemplary embodiment, the motor of the linear compressor may include a coil part having a first coil and a second coil, and a switching element that controls a coil corresponding to the motor to be a coil in a form of selectively combining the first coil and the second coil or the first coil in a selective manner according to a switching control signal.

In accordance with one exemplary embodiment, the switching control signal may be generated based on the load of the linear compressor.

In accordance with one exemplary embodiment, the controller may generate the switching control signal such that the coil corresponding to the motor can be the first coil when the load of the linear compressor is greater than a second reference load, and generate the switching control signal such that the coil corresponding to the motor can be the coil in the form of selectively combining the first coil and the second coil when the load of the linear compressor is smaller than the second reference load.

In accordance with one exemplary embodiment, the controller may set the current offset to '0' when the load of the linear compressor is smaller than the first reference load, set the current offset to a specific value when the load of the linear compressor is greater than the first reference load and smaller than the second reference load, and generate the switching control signal such that the coil corresponding to the motor can be the first coil when the load of the linear compressor is greater than a third reference load.

In accordance with one exemplary embodiment, the third reference load may be the same as the second reference load or greater than the second reference load.

Here, the specific value may be decided based on the load of the linear compressor or a freezing capacity command value corresponding to the linear compressor.

In accordance with one exemplary embodiment, the controller may detect the load of the linear compressor, based on at least one of an absolute value for a phase difference between a current applied to the linear compressor and a stroke, an outer temperature of the linear compressor, an inner temperature of the linear compressor, and a temperature of a condenser and an evaporator within a refrigeration cycle.

In accordance with one exemplary embodiment, the switching element may be a relay.

In accordance with one exemplary embodiment, the switching control signal may be generated based on a driving mode of the linear compressor.

Here, the driving mode of the linear compressor may be at least one of a high-efficiency mode and an overload management mode.

In this case, the controller may generate the switching control signal such that the coil corresponding to the motor can selectively be the coil in the form of selectively combining the first coil and the second coil when the driving mode is the high-efficiency mode, and generate the switching control signal such that the coil corresponding to the motor can be the first coil when the driving mode is the overload management mode.

Also, the overload management mode may be a driving mode corresponding to a case where the detected motor current is below '0' for a predetermined time, or may be decided based on a shortage of a motor voltage of the linear compressor due to an overload state, a load of the linear compressor or a freezing capacity command value corresponding to the linear compressor.

In accordance with one exemplary embodiment, the drive circuitry may be implemented as an inverter or a triac.

In accordance with one exemplary embodiment, the controller may set the current offset to '0' when the operation mode is the symmetric control mode, and generate the switching control signal such that the coil corresponding to the motor can be the coil in the form of selectively combining the first coil and the second coil. The controller may set the current offset value to a specific value when the operation mode is the asymmetric control mode, and generate the switching control signal such that the coil corresponding to the motor can be the coil in the form of selectively combining the first coil and the second coil. The controller may generate the switching control signal such that the coil corresponding to the motor can be the first coil when the operation mode is the overload management mode.

A linear compressor in accordance with exemplary embodiments disclosed herein to achieve the aspects and advantages of the present disclosure may include a fixed member having an inner compression space, a movable member which compresses a refrigerant introduced into the compression space while linearly reciprocating within the fixed member, at least one spring which is installed to elastically support the movable member in a motion direction of the movable member, a motor which is connected to the movable member to linearly reciprocate the movable member in an axial direction, and a control module of the linear compressor. Here, the control module of the linear compressor may be the control module of the linear compressor according to the aforementioned exemplary embodiments.

A refrigerator in accordance with the aforementioned exemplary embodiments to achieve the aspects and advantages of the present disclosure may include a refrigerator main body, a linear compressor which is disposed in the refrigerator main body and compresses a refrigerant, and a control module of the linear compressor. The control module of the linear compressor may be the control module of the linear compressor according to the aforementioned exemplary embodiments.

A compressor control method according to exemplary embodiments disclosed herein to achieve the aspects and advantages of the present disclosure may include detecting a motor current and a motor voltage corresponding to a motor of a linear compressor, generating an asymmetric motor current by applying a current offset to the detected motor current, generating a control signal based on the asymmetric motor current and the detected motor voltage, and driving the linear compressor based on the control signal.

In accordance with one exemplary embodiment, the current offset may be decided based on an operation mode of the linear compressor, a load of the linear compressor, or a freezing capacity command value corresponding to the linear compressor.

In accordance with one exemplary embodiment, the operation mode may be at least one of a symmetric control mode and an asymmetric control mode.

In accordance with one exemplary embodiment, the current offset may be set to '0' when the operation mode is the symmetric control mode, and set to a specific value when the operation mode is the asymmetric control mode.

In accordance with one exemplary embodiment, the current offset may be set to '0' when the load of the linear compressor is less than a first reference load or the freezing capacity command value is less than a first reference freezing capacity.

In accordance with one exemplary embodiment, the linear compressor may be a resonance compressor which carries out a resonance operation based on an inductor corresponding to a motor and a virtual capacitor. Here, the virtual capacitor may be implemented in such a manner that the asymmetric motor current is generated based on a capacitor voltage which is obtained by multiplying a specific constant value by an integrated value.

In accordance with one exemplary embodiment, the motor of the linear compressor may include a coil part having a first coil and a second coil, and a switching element that controls a coil corresponding to the motor to be a coil in a form of selectively combining the first coil and the second coil or the first coil according to a switching control signal.

In accordance with one exemplary embodiment, the switching control signal may be generated based on the load of the linear compressor.

In accordance with one exemplary embodiment, the switching control signal may control the switching element such that the coil corresponding to the motor can be the first coil when the load of the linear compressor is greater than a second reference load, and control the switching element such that the coil corresponding to the motor can be the coil in the form of selectively combining the first coil and the second coil when the load of the linear compressor is smaller than the second reference load.

In accordance with a control module of a linear compressor and a control method thereof according to one exemplary embodiment disclosed herein, an optimal freezing capacity may be increased by way of basically setting a small initial position (or a small initial value) of a piston and electrically moving the initial value of the piston in a high-load driving area (i.e., controlling a piston push amount). This may result in ensuring control stability and optimizing efficiency of the compressor.

A technology disclosed herein relates to a device and method for a linear compressor, and especially, a control module for a motor disclosed herein may be used for compressors, which are applied to a refrigerator, an air conditioner or the like. However, the technology disclosed herein may not be limited to this, but applicable to various types of home appliances or electronics for which the control module of the motor can be used.

It should be noted that technological terms used herein are merely used to describe a specific embodiment, but not to limit the present invention. Terms connoting structure to one of ordinary skill in the art should not be interpreted as means function. Further, unless the terms "means for" is specifically used, the terms used herein are not intended to be interpreted as a means function language.

Furthermore, the terms including an ordinal number such as first, second, etc. can be used to describe various elements, but the elements should not be limited by those terms. The terms are used merely for the purpose to distinguish an element from the other element.

A control module is capable of controlling the number of turns of a motor coil for managing an overload upon an occurrence of an overload of the compressor, and a control method thereof.

A control module capable of controlling the number of turns of a motor may include a drive circuitry which drives the linear compressor based on a control signal, a detector which detects a motor current and a motor voltage corresponding to a motor of the linear compressor, an asymmetric current generator which generates an asymmetric motor current by applying a current offset to the detected motor current, and a controller which generates the control signal based on the asymmetric motor current and the detected motor voltage.

In the embodiment where a module capable of controlling the number of turns of a motor, the motor of the linear compressor may include a coil part having a first coil and a second coil, and a switching element, which controls a coil corresponding to the motor to be a coil in a form of selectively combining the first coil and the second coil or the first coil according to a switching control signal. The switching element may be a relay. The switching control signal may be generated based on a load of the linear compressor. The switching control signal may be generated based on a driving mode of the linear compressor.

In the embodiment where a control module capable of controlling the number of turns of a motor, the driving mode of the linear compressor may be at least one of a high-efficiency mode and an overload management mode.

In the embodiment where a control module capable of controlling the number of turns of a motor, the controller may generate the switching control signal such that the coil corresponding to the motor can be the coil in the form of selectively combining the first coil and the second coil for increasing efficiency of the linear compressor when the driving mode is the high-efficiency mode, and generate the switching control signal such that the coil corresponding to the motor can be the first coil for reducing the shortage of voltage applied to the motor of the linear compressor when the driving mode is the overload management mode.

In the embodiment where a control module capable of controlling the number of turns of a motor, the overload management mode may be a driving mode corresponding to a case where the detected motor current is below '0' for a predetermined time, or may be decided based on the shortage of the motor voltage of the linear compressor due to an overload state, a load of the linear compressor, or a freezing capacity command value corresponding to the linear compressor.

In the embodiment where a control module capable of controlling the number of turns of a motor, the controller may generate the switching control signal such that the coil corresponding to the motor can be the first coil when the load of the linear compressor is greater than a second reference load (corresponding to the overload management mode), and generate the switching control signal such that the coil corresponding to the motor can be the coil in the form of selectively combining the first coil and the second coil when the load of the linear compressor is smaller than the second reference load (corresponding to the high-efficiency mode). The second reference load may be a load over 300 watts [W].

In the embodiment where a control module capable of controlling the number of turns of a motor, the controller may detect the load of the linear compressor. Here, the load of the linear compressor may be detected based on at least one of an absolute value for a phase difference between a current applied to the linear compressor and a stroke, an outer temperature of the linear compressor, an inner temperature of the linear compressor, and a temperature of a condenser and an evaporator within a refrigeration cycle.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A control module for a linear compressor, comprising: a drive circuitry that is configured to drive the linear compressor based on a control signal; a detector to detect a motor current and a motor voltage corresponding to a motor of the linear compressor; an asymmetric current generator to generate an asymmetric motor current by applying a current offset to the detected motor current; and a controller to detect a stroke based on the detected motor voltage and to generate the control signal based on at least one of the asymmetric motor current, the detected motor voltage or the detected stroke, wherein the control signal adjusts motor speed to control the linear compressor, wherein the controller detects a phase difference between a phase of the asymmetric motor current and a phase of the detected stroke, and wherein the controller generates the control signal such that output power of the linear compressor is controlled based on the phase difference.

2. The control module of claim 1, wherein the current offset is adjusted based on to an operation mode of the linear compressor, and wherein the operation mode is at least one of a symmetric control mode or an asymmetric control mode, and determined based on a load of the linear compressor or a freezing capacity command value corresponding to the linear compressor.

3. The control module of claim 2, wherein the symmetric control mode is to set the current offset to '0', wherein the asymmetric control mode is to set the current offset to a specific value, and wherein the specific value is decided based on the load of the linear compressor or the freezing capacity command value.

4. The control module of claim 1, wherein the current offset is changed according to a change in a load of the linear compressor or a freezing capacity command value corresponding to the linear compressor.

5. The control module of claim 4, wherein the controller detects the load of the linear compressor, sets the current offset corresponding to the detected load, and controls the asymmetric current generator to generate the asymmetric motor current to which the set current offset is applied.

6. The control module of claim 5, wherein the load of the linear compressor is detected based on at least one of an absolute value for a phase difference between a current applied to the linear compressor and the detected stroke, an outer temperature of the linear compressor, an inner temperature of the linear compressor, or a temperature of a condenser and an evaporator within a refrigeration cycle.

7. The control module of claim 4, wherein the controller sets the current offset corresponding to the freezing capacity command value, and controls the asymmetric current generator to generate the asymmetric motor current to which the set current offset is applied.

8. The control module of claim 1, wherein a push amount of a piston, which is included in the motor of the linear compressor, due to the current offset is in proportion to a motor constant corresponding to the motor of the linear compressor and the current offset, and wherein the controller adjusts the current offset based on the motor constant.

9. The control module of claim 1, wherein the linear compressor is a resonance compressor that carries out a resonance operation based on an inductor corresponding to the motor and a virtual capacitor, and wherein the controller integrates the asymmetric motor current, calculates a capacitor voltage by multiplying the integrated value by a specific constant, and implements a function of the virtual capacitor by generating the control signal based on the calculated capacitor voltage.

10. The control module of claim 9, wherein the control signal is a voltage control signal generated by a pulse width modulation (PWM), and wherein the controller generates a changed PWM reference signal by subtracting the calculated capacitor voltage from a PWM reference signal of a sine wave type to adjust a pulse width of the voltage control signal, and generates the voltage control signal based on the changed PWM reference signal.

11. The control module of claim 9, wherein the controller controls an operating frequency of the linear compressor to track a mechanical resonant frequency of the linear compressor, and wherein when the operating frequency is adjusted due to a change in the mechanical resonant frequency during an operation of the linear compressor, the controller adjusts the specific constant in such a manner that an electric resonant frequency, which is based on an inductor corresponding to the motor and the virtual capacitor, tracks the adjusted operating frequency.

12. The control module of claim 1, wherein the controller detects a top dead center of the linear compressor based on the phase difference and generates the control signal based on the detected top dead center.

13. The control module of claim 1, wherein the controller detects a spring constant corresponding to the motor of the linear compressor based on the phase difference, the asymmetric motor current and the detected stroke, and wherein the controller generates the control signal such that output power of the linear compressor is controlled based on the spring constant, or detects a top dead center of the linear compressor based on the spring constant and generates the control signal based on the detected top dead center.

14. The control module of claim 1, wherein the motor of the linear compressor comprises a coil including a first coil and a second coil, and a switch is configured to control a coil of the motor to be a combination of at least one of the first coil or the second coil according to a switching control signal.

15. The control module of claim 14, wherein the controller generates the switching control signal such that the coil corresponding to the motor is the first coil when the load of the linear compressor is greater than a reference load, and wherein the controller generates the switching control signal such that the coil corresponding to the motor to be a combination of the first coil and the second coil when the load of the linear compressor is smaller than the reference load.

16. A linear compressor, comprising:

a fixed member having an inner compression space;

a movable member configured to compress a refrigerant introduced into the compression space while linearly reciprocates within the fixed member;

at least one spring that elastically supports the movable member in a motion direction of the movable member;

a motor connected to the movable member to linearly reciprocate the movable member in an axial direction; and a control module, wherein the control module comprises the control module of claim 1.

17. A refrigerator, comprising:

a refrigerator main body;

a linear compressor disposed in the refrigerator main body and configured to compress a refrigerant; and a control module for the linear compressor, wherein the control module comprises the control module corresponding to claim 1.

18. A method of controlling a linear compressor, the method comprising: detecting a motor current and a motor voltage corresponding to a motor of the linear compressor; generating an asymmetric motor current by applying a current offset to the detected motor current; generating a control signal based on the asymmetric motor current and the detected motor voltage, wherein the control signal adjusts motor speed to control the linear compressor; and driving the linear compressor based on the control signal, wherein the detecting of the motor current and the motor voltage comprises: detecting a stroke based on the detected motor voltage; and detecting a phase difference between a phase of the asymmetric motor current and a phase of the detected stroke, wherein the generating of the control signal comprises: generating the control signal such that output power of the linear compressor is controlled based on the phase difference.

* * * * *